US008066410B2

(12) United States Patent
Booth et al.

(10) Patent No.: US 8,066,410 B2
(45) Date of Patent: Nov. 29, 2011

(54) LIGHT FIXTURE WITH MULTIPLE LEDS AND SYNTHETIC JET THERMAL MANAGEMENT SYSTEM

(75) Inventors: John Stanley Booth, Austin, TX (US); Raghavendran Mahalingam, Austin, TX (US); Lee M. Jones, Austin, TX (US); Daniel N. Grimm, Round Rock, TX (US); Paul Pergande, Austin, TX (US)

(73) Assignee: Nuventix, Inc., Austin, TX (US)

( * ) Notice: Subject to any disclaimer, the term of this patent is extended or adjusted under 35 U.S.C. 154(b) by 352 days.

(21) Appl. No.: 12/288,144

(22) Filed: Oct. 16, 2008

(65) Prior Publication Data

US 2009/0109625 A1 Apr. 30, 2009

Related U.S. Application Data

(60) Provisional application No. 61/000,321, filed on Oct. 24, 2007.

(51) Int. Cl.
*F21V 29/02* (2006.01)

(52) U.S. Cl. ..... 362/294; 361/697

(58) Field of Classification Search ..... 361/697; 362/294, 480, 547, 218, 264
See application file for complete search history.

(56) References Cited

U.S. PATENT DOCUMENTS

| | | | | |
|---|---|---|---|---|
| 6,511,209 | B1 * | 1/2003 | Chiang | 362/294 |
| 7,204,615 | B2 * | 4/2007 | Arik et al. | 362/294 |
| 2005/0174780 | A1 * | 8/2005 | Park | 362/294 |
| 2006/0193139 | A1 * | 8/2006 | Sun et al. | 362/373 |
| 2007/0096118 | A1 * | 5/2007 | Mahalingam et al. | 257/81 |

* cited by examiner

*Primary Examiner* — Robert May
*Assistant Examiner* — Leah S Lovell
(74) *Attorney, Agent, or Firm* — John A. Fortkort; Fortkort & Houston, P.C.

(57) ABSTRACT

A light source (101) is provided which comprises (a) a housing element (107); (b) a heat sink (109); (c) a first flow channel element (111) which, alone or in combination with said housing element, creates (i) a first set of flow paths (221) for the flow of fluid in a first direction through the light source, and (ii) a second set of flow paths (223) for the flow of fluid in a second direction through the light source; (d) a set of synthetic jet actuators (143, 145) having at least one member and being in fluidic communication with said first set of flow paths; and (e) a set of LEDs (113) containing at least one member and being in thermal contact with said heat sink.

26 Claims, 39 Drawing Sheets

LIGHT FIXTURE WITH MULTIPLE LEDS AND SYNTHETIC JET THERMAL MANAGEMENT SYSTEM

CROSS-REFERENCE TO RELATED APPLICATION

This application claims the benefit of priority from U.S. Provisional Application No. 61/000,321, filed Oct. 24, 2007, having the same title, and having the same inventors, and which is incorporated herein by reference in its entirety.

FIELD OF THE DISCLOSURE

The present disclosure relates generally to light fixtures, and more particularly to the thermal management of LED light fixtures with synthetic jet ejectors.

BACKGROUND OF THE DISCLOSURE

A variety of thermal management devices are known to the art, including conventional fan based systems, piezoelectric systems, and synthetic jet ejectors. The latter type of system has emerged as a highly efficient and versatile solution where thermal management is required at the local level. Frequently, synthetic jet ejectors are utilized in conjunction with a conventional fan based system. In such hybrid systems, the fan based system provides a global flow of fluid through the device being cooled, and the synthetic jet ejectors provide localized cooling for hot spots and also augment the global flow of fluid through the device by perturbing boundary layers.

Various examples of synthetic jet ejectors are known to the art. Some examples include those disclosed in U.S. 20070141453 (Mahalingam et al.) entitled "Thermal Management of Batteries using Synthetic Jets"; U.S. 20070127210 (Mahalingam et al.), entitled "Thermal Management System for Distributed Heat Sources"; 20070119575 (Glezer et al.), entitled "Synthetic Jet Heat Pipe Thermal Management System"; 20070119573 (Mahalingam et al.), entitled "Synthetic Jet Ejector for the Thermal Management of PCI Cards"; 20070096118 (Mahalingam et al.), entitled "Synthetic Jet Cooling System for LED Module"; 20070081027 (Beltran et al.), entitled "Acoustic Resonator for Synthetic Jet Generation for Thermal Management"; and 20070023169 (Mahalingam et al.), entitled "Synthetic Jet Ejector for Augmentation of Pumped Liquid Loop Cooling and Enhancement of Pool and Flow Boiling".

SUMMARY OF THE DISCLOSURE

In one aspect, a light source is provided which comprises (a) a housing element; (b) a heat sink having a central portion and having a plurality of fins, wherein said plurality of fins are disposed about the periphery of said heat sink; (c) a first flow channel element which extends between said housing element and the periphery of said heat sink, said flow channel element creating a first set of flow paths for the flow of fluid in a first direction, and creating a second set of flow paths for the flow of fluid in a second direction; and (d) a set of LEDs containing at least one member and being disposed on said central portion of said heat sink.

In another aspect, a light source is provided which comprises (a) a housing element; (b) a heat sink; (c) a first flow channel element which, in combination with said housing element, creates a first set of flow paths for the flow of fluid in a first direction through the light source, and a second set of flow paths for the flow of fluid in a second direction through the light source; (d) a set of synthetic jet actuators having at least one member and being in fluidic communication with said first set of flow paths; and (e) a set of LEDs containing at least one member and being in fluidic communication with said first set of flow paths.

In a further aspect, a light source is provided which comprises (a) a housing element; (b) a heat sink having a having a plurality of fins; (c) a first set of flow paths for the flow of fluid in a first direction; (d) a second set of flow paths for the flow of fluid in a second direction, wherein said first and second directions are essentially opposite; and (e) at least one LED disposed on said heat sink.

DETAILED DESCRIPTION

Figure 1:
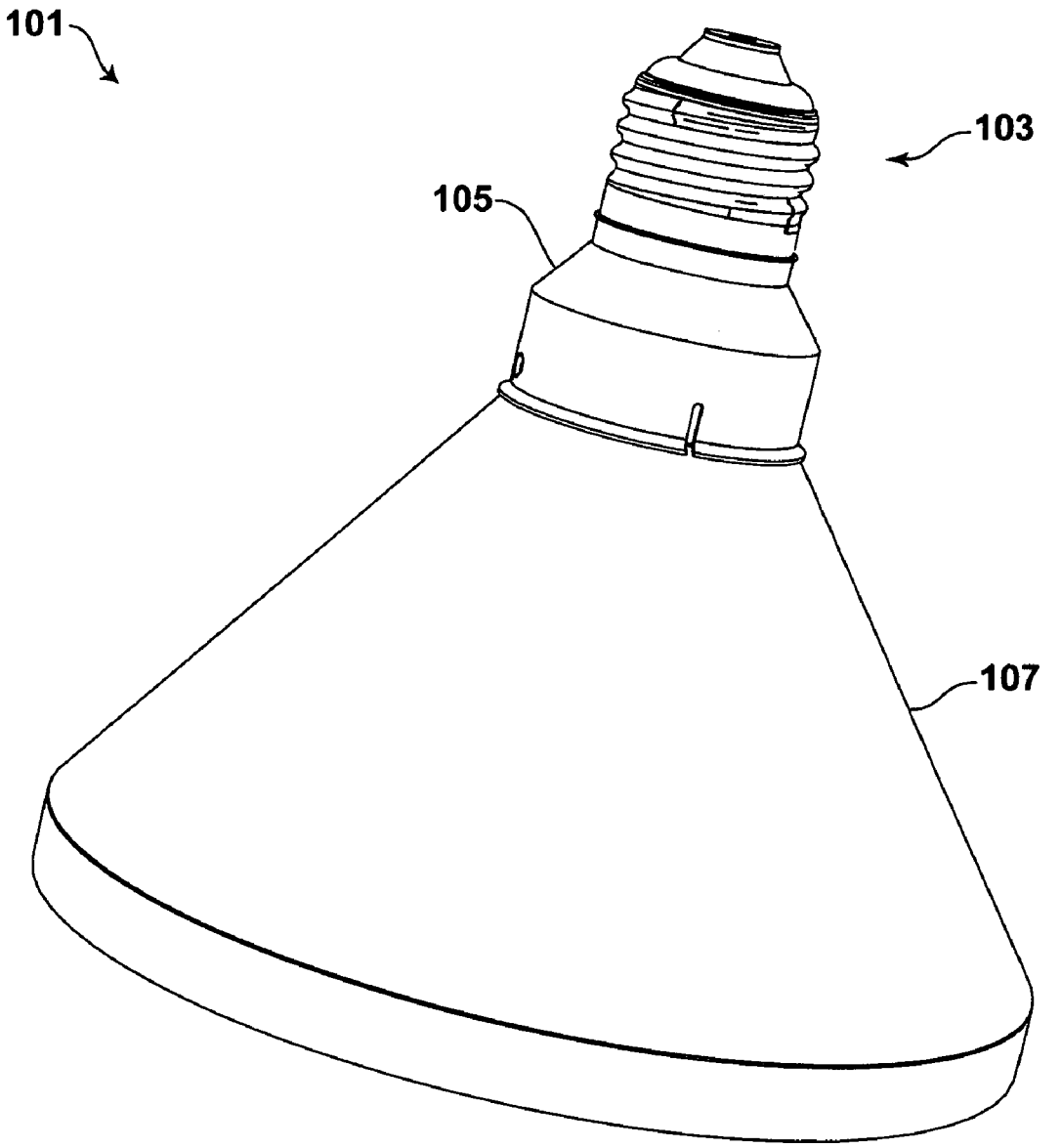
FIG. 1 is a perspective view of a light source made in accordance with the teachings herein.

A first particular, non-limiting embodiment of a light source made in accordance with the teachings herein is depicted in FIGS. 1-35. With reference to FIG. 1, the light source 101 in this particular embodiment comprises an electrical contact module 103, an adaptor 105 and an exterior housing element 107.

Figure 37:
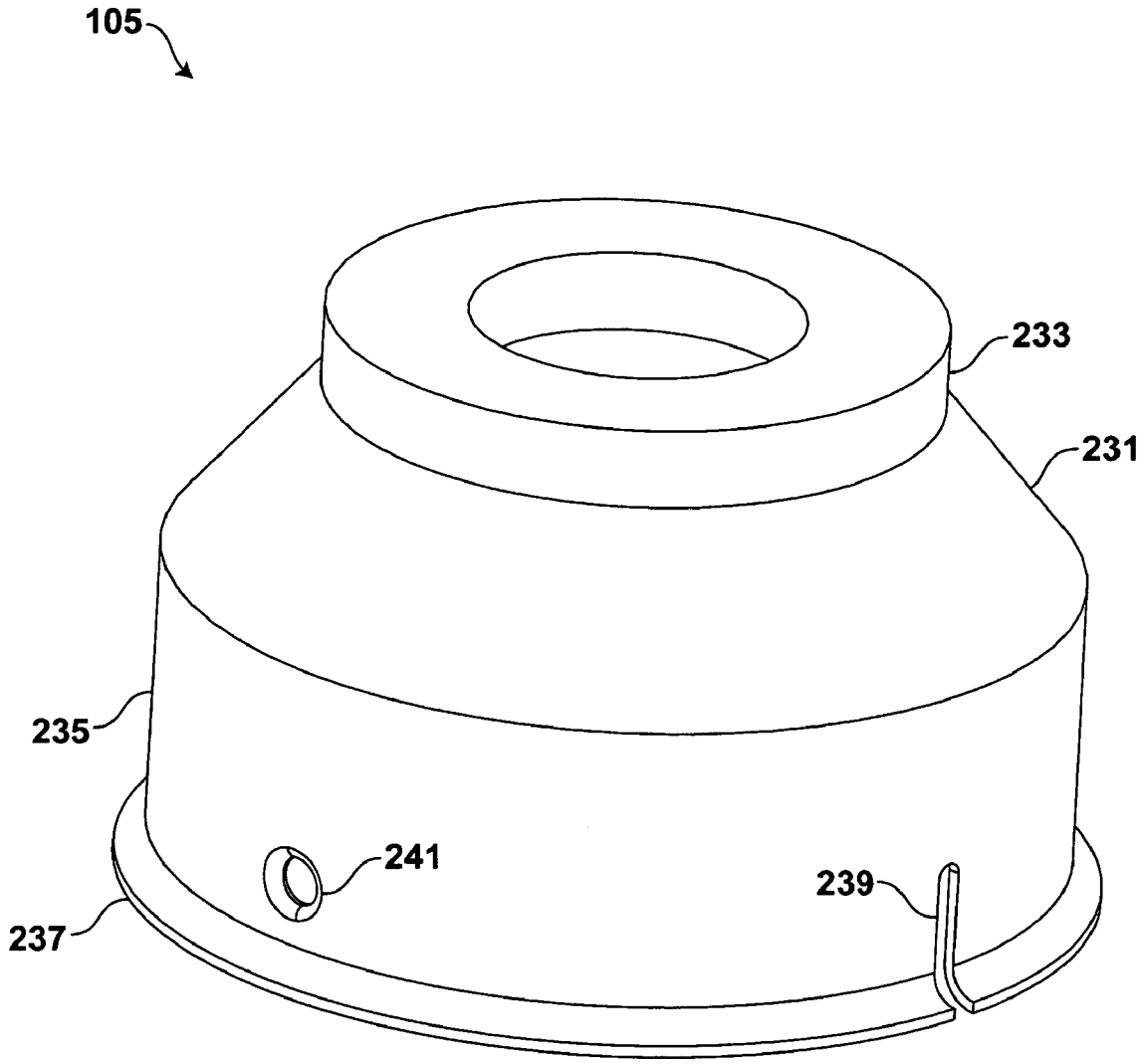
FIG. 37 is a perspective view of the adapter of FIG. 9 in greater detail.
Figure 38:
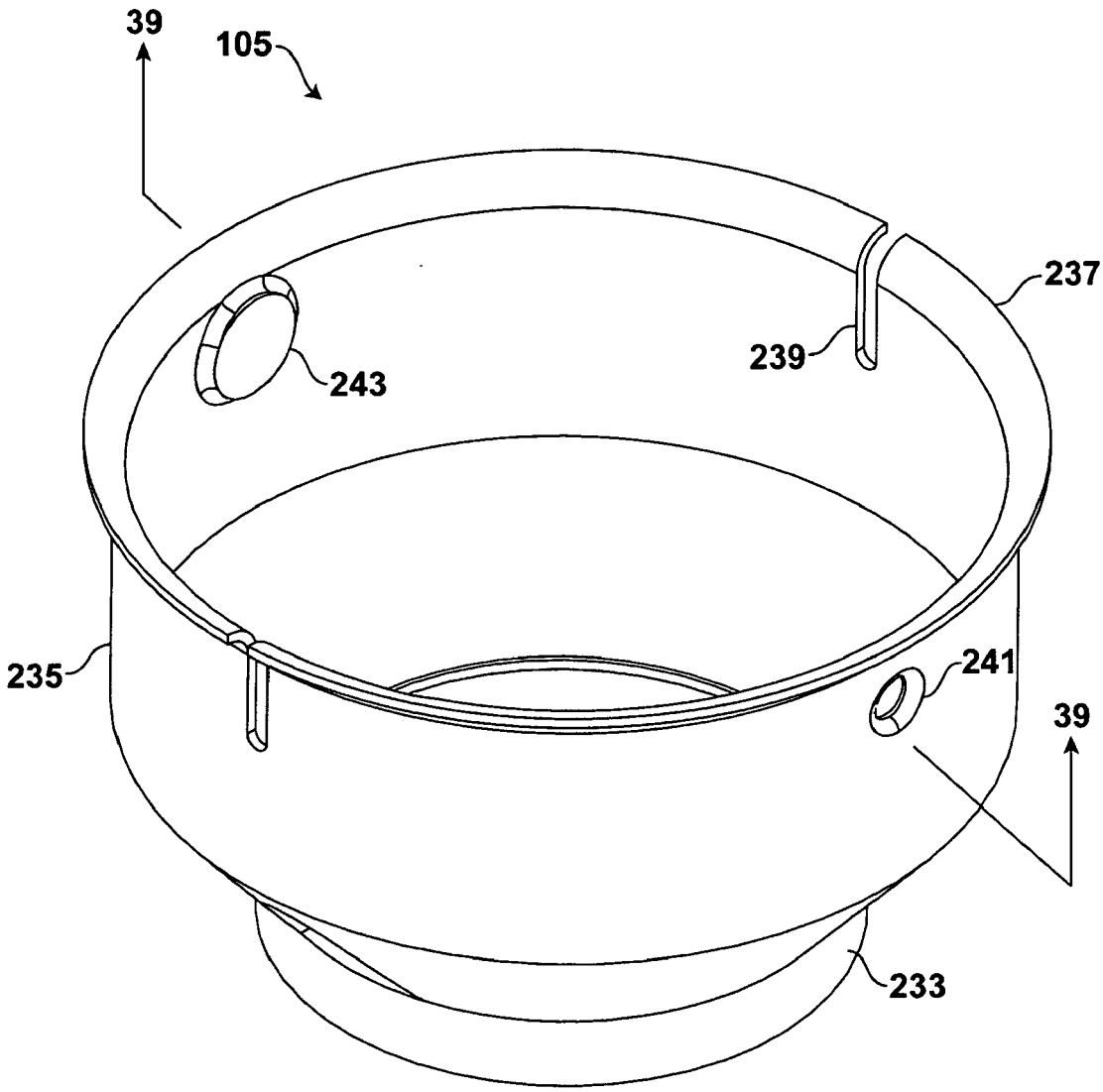
FIG. 38 is a perspective view of the adapter of FIG. 9 in greater detail.
Figure 39:
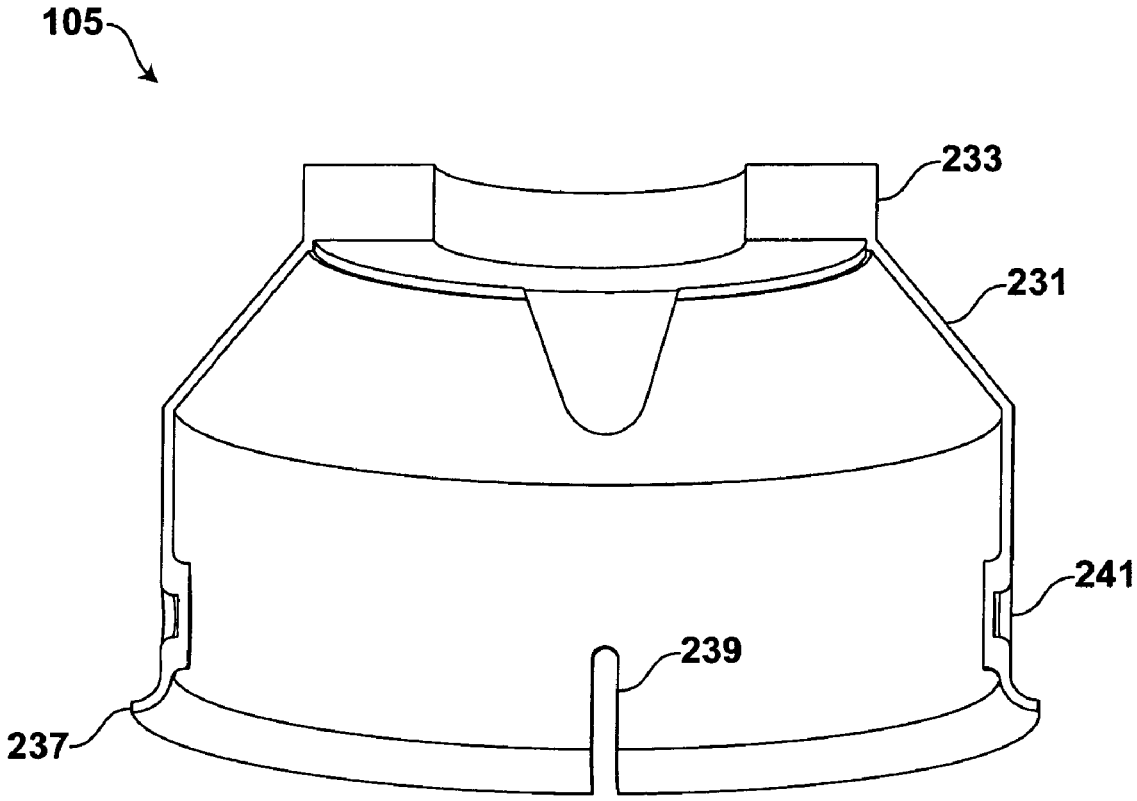
FIG. 39 is a cross-sectional view taken along LINE 39-39 of FIG. 38.

The adapter 105, which is shown in greater detail in FIGS. 37-39, comprises a conical portion 231 which terminates on one end in a first annular portion 233, and which terminates on the other end in a second annular portion 235. The second annular portion 235 terminates in a lip 237 and is equipped with one or more grooves 239 which render it slightly flexible. The second annular portion 235 is also equipped with a plurality of apertures 241 which may be utilized in conjunction with various types of fasteners in the assembly of the light source 101.

Figure 19:
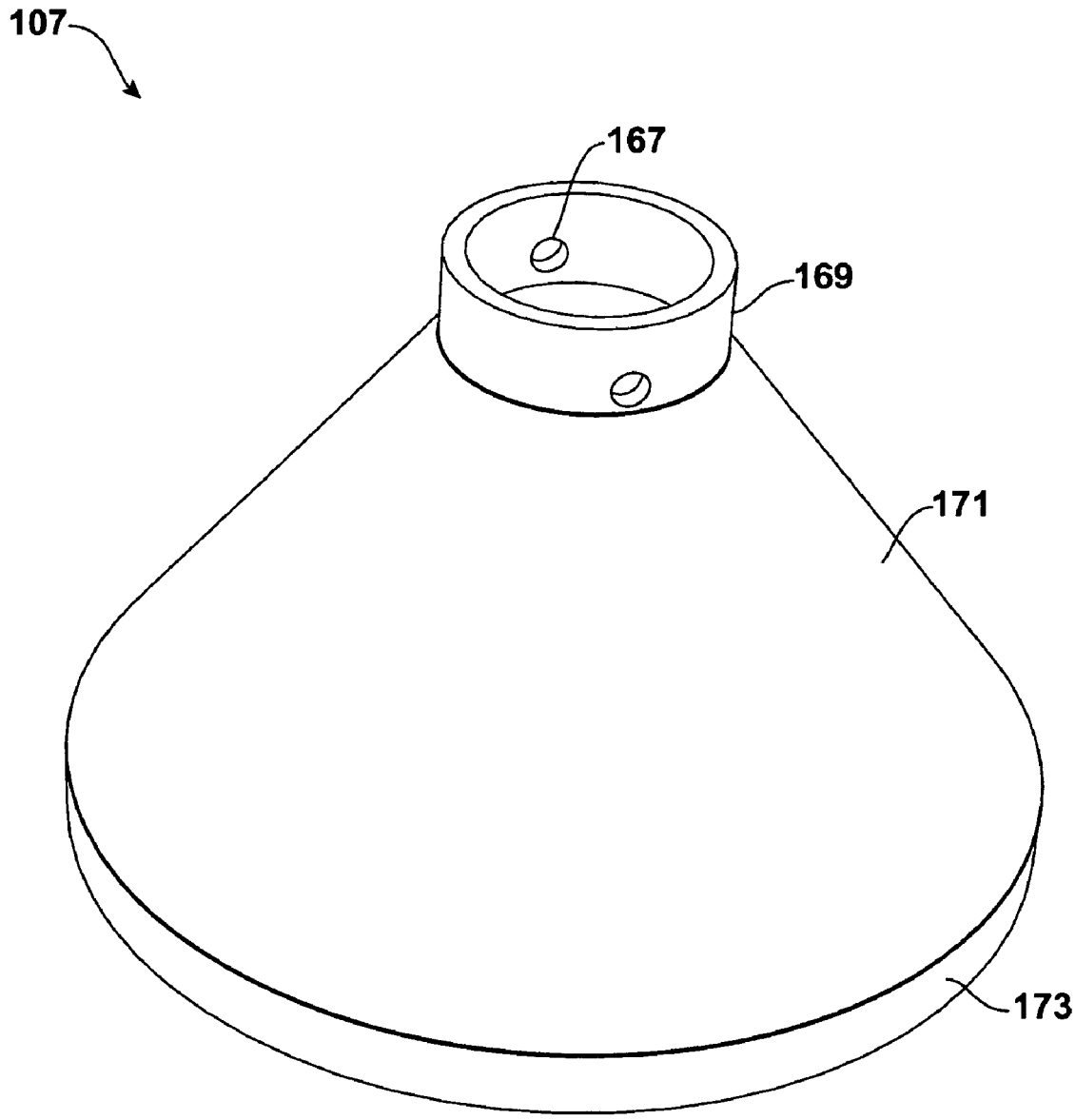
FIG. 19 is a perspective view of the exterior housing element of the light source of FIG. 1.
Figure 20:
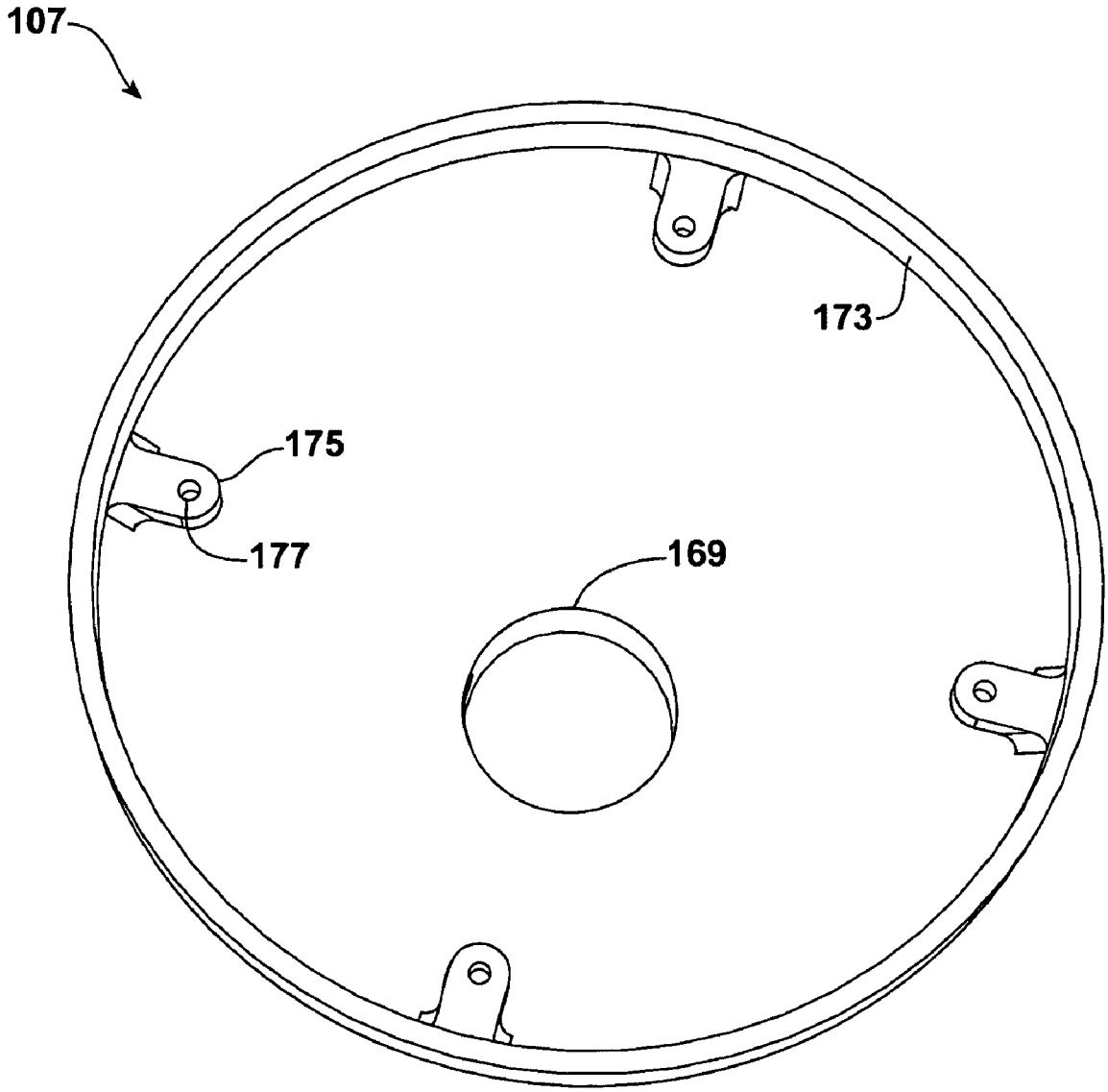
FIG. 20 is a perspective view of the interior of the housing element of the light source of FIG. 1.
Figure 21:
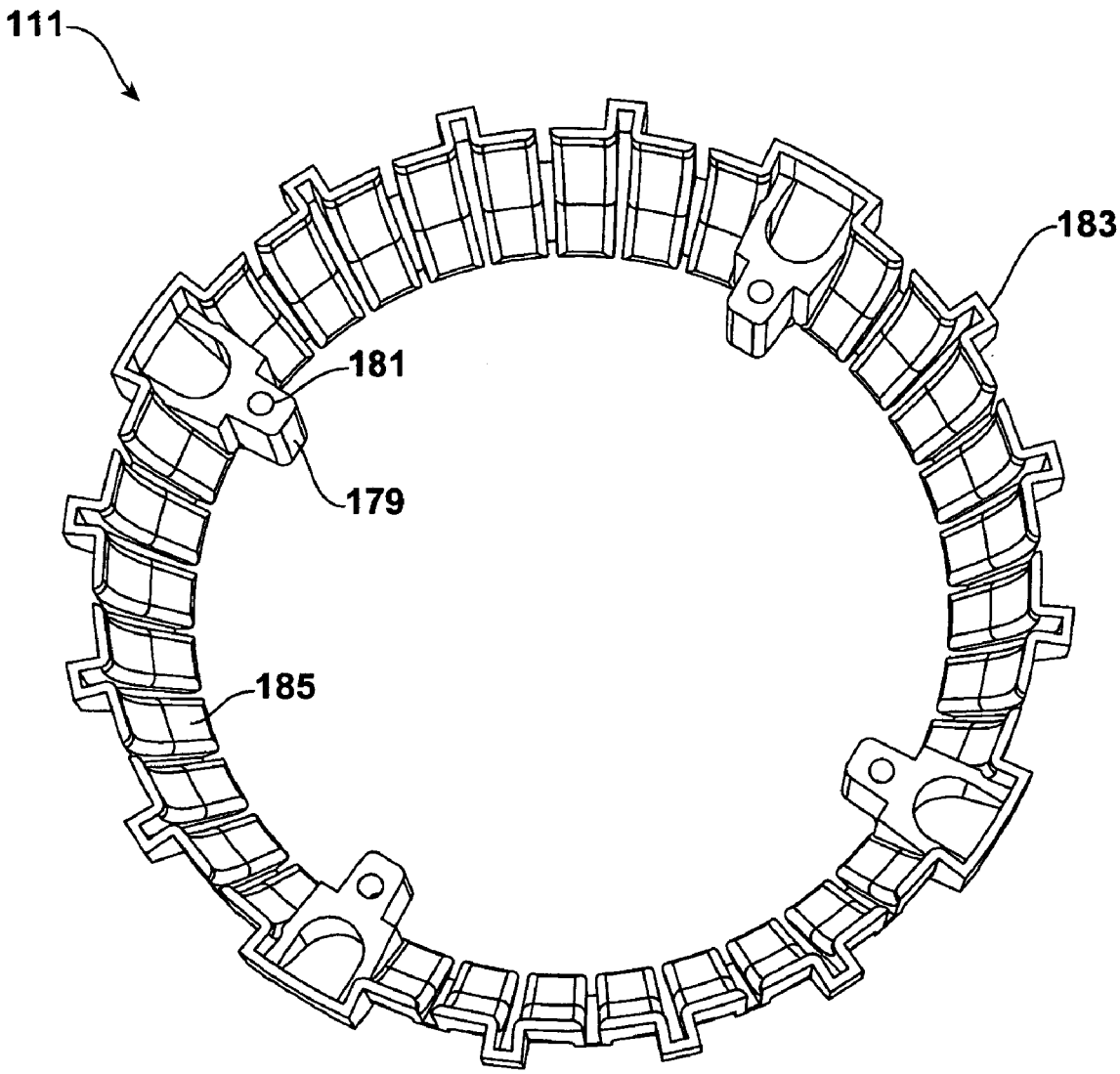
FIG. 21 is a perspective view showing the interior of the first flow channel element of the light source of FIG. 1.
Figure 22:
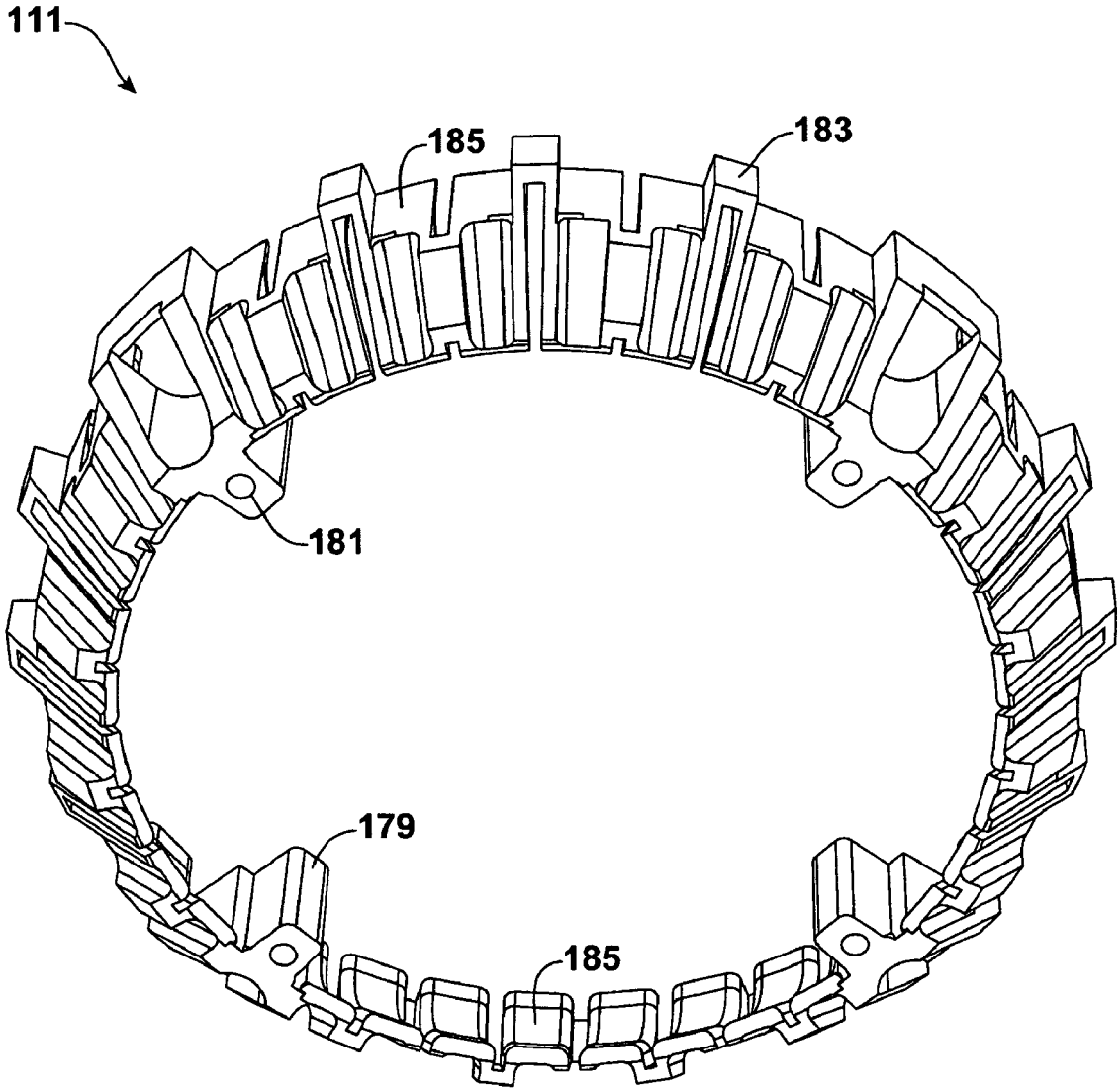
FIG. 22 is a perspective view showing the exterior of the housing element of the light source of FIG. 1.
Figure 23:
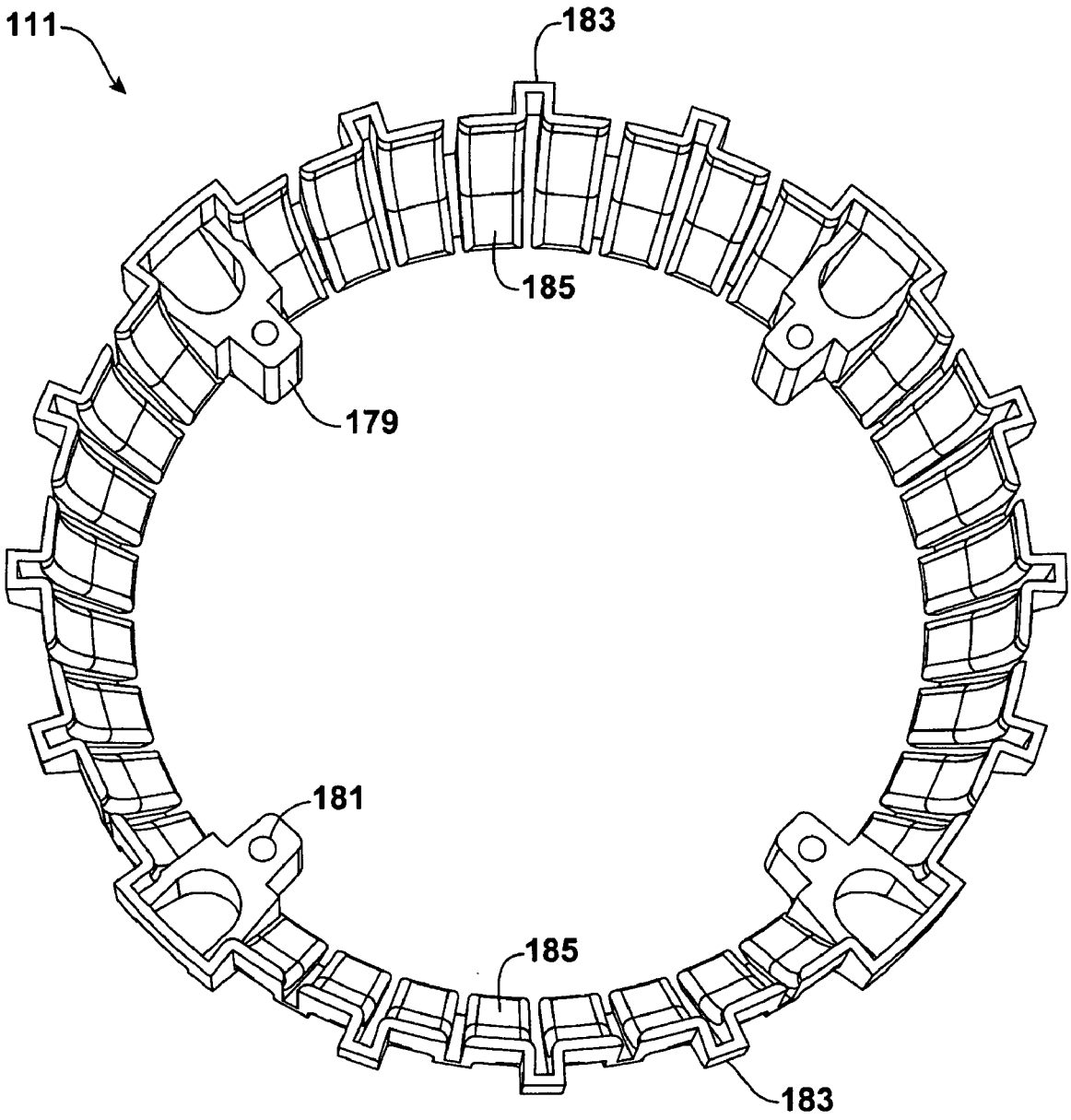
FIG. 23 is a perspective view showing the interior of the first flow channel element of the light source of FIG. 1.

The exterior housing element is shown in greater detail in FIG. 19. As seen therein, the exterior housing element 107 comprises a conical portion 171 which terminates on one end in a first annular portion 169, and which terminates on the other end in a second annular portion 173. The conical portion 171 tapers outward such that the second annular portion is of significantly larger diameter then the first annular portion 169. A plurality of apertures 167 are provided in the first annular portion 169 which may be utilized in conjunction with various types of fasteners in the assembly of the light source 101. As seen in FIG. 1 and in the cross-sectional illustrations of FIGS. 4-6, the electrical contact module 103 is seated on the first annular portion 233 of the adapter 105, which in turn is seated on the first annular portion 169 of the exterior housing element.

Figure 2:
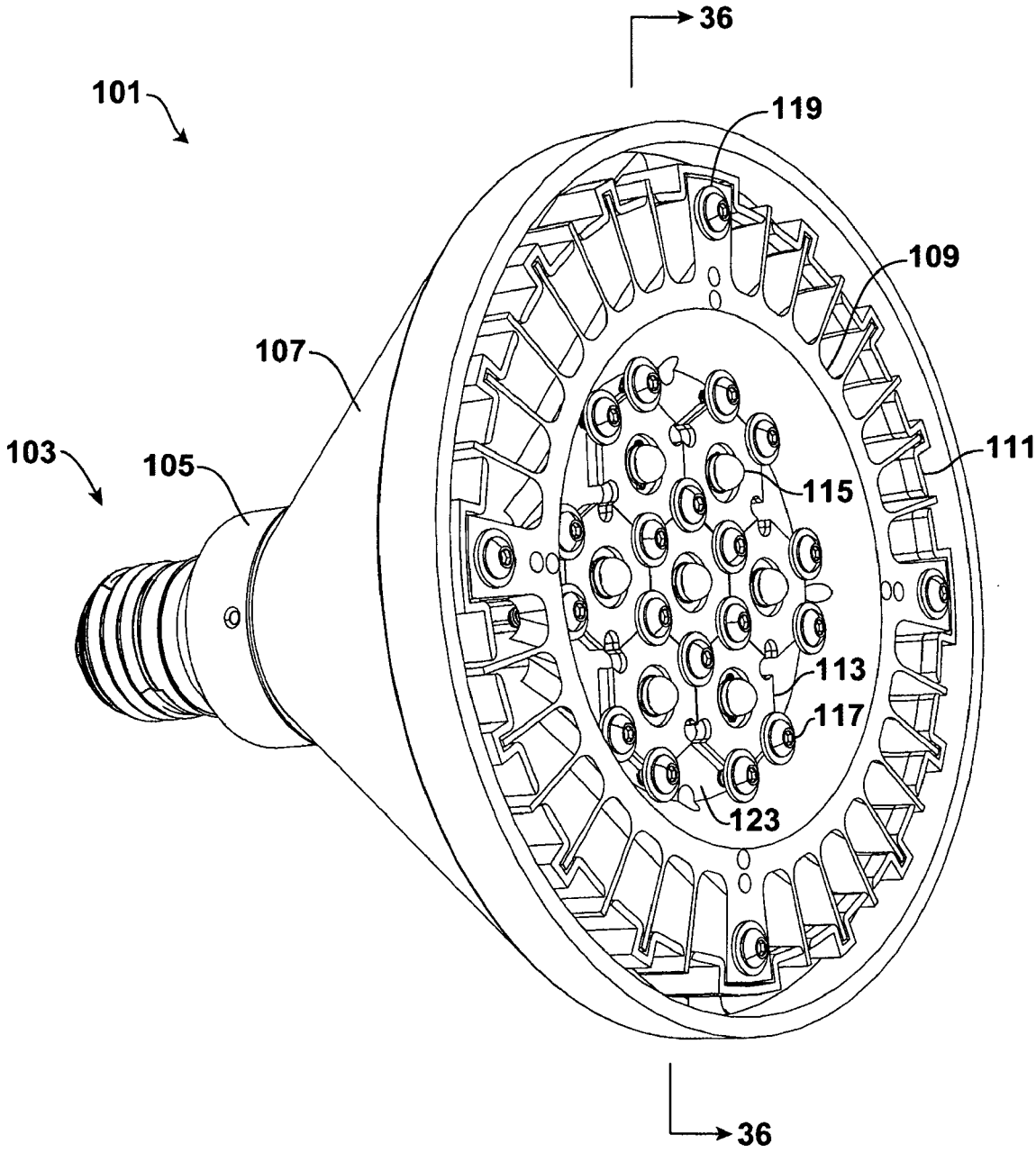
FIG. 2 is a perspective view of a light source made in accordance with the teachings herein.
Figure 3:
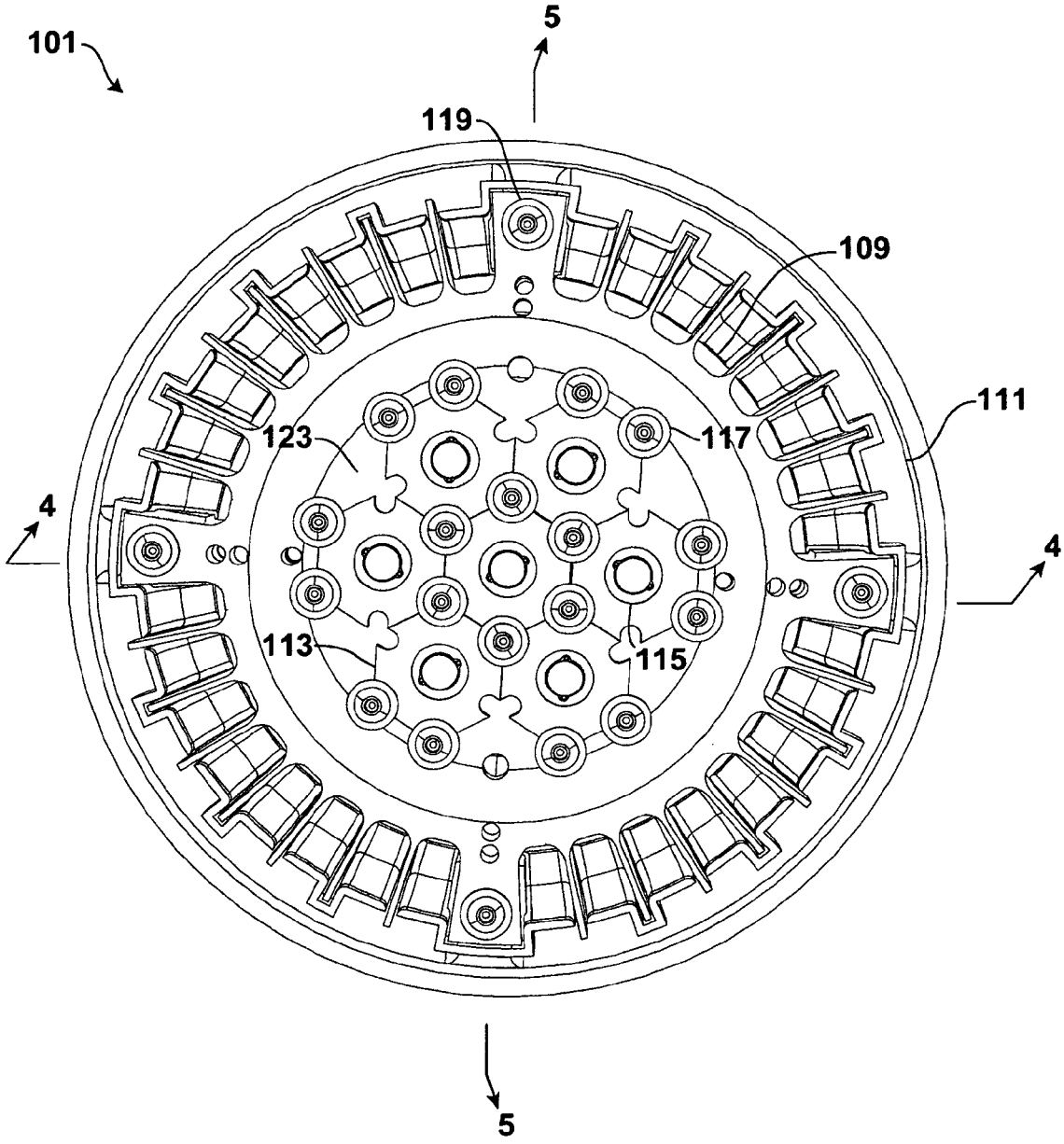
FIG. 3 is a perspective view of a light source made in accordance with the teachings herein.
Figure 4:
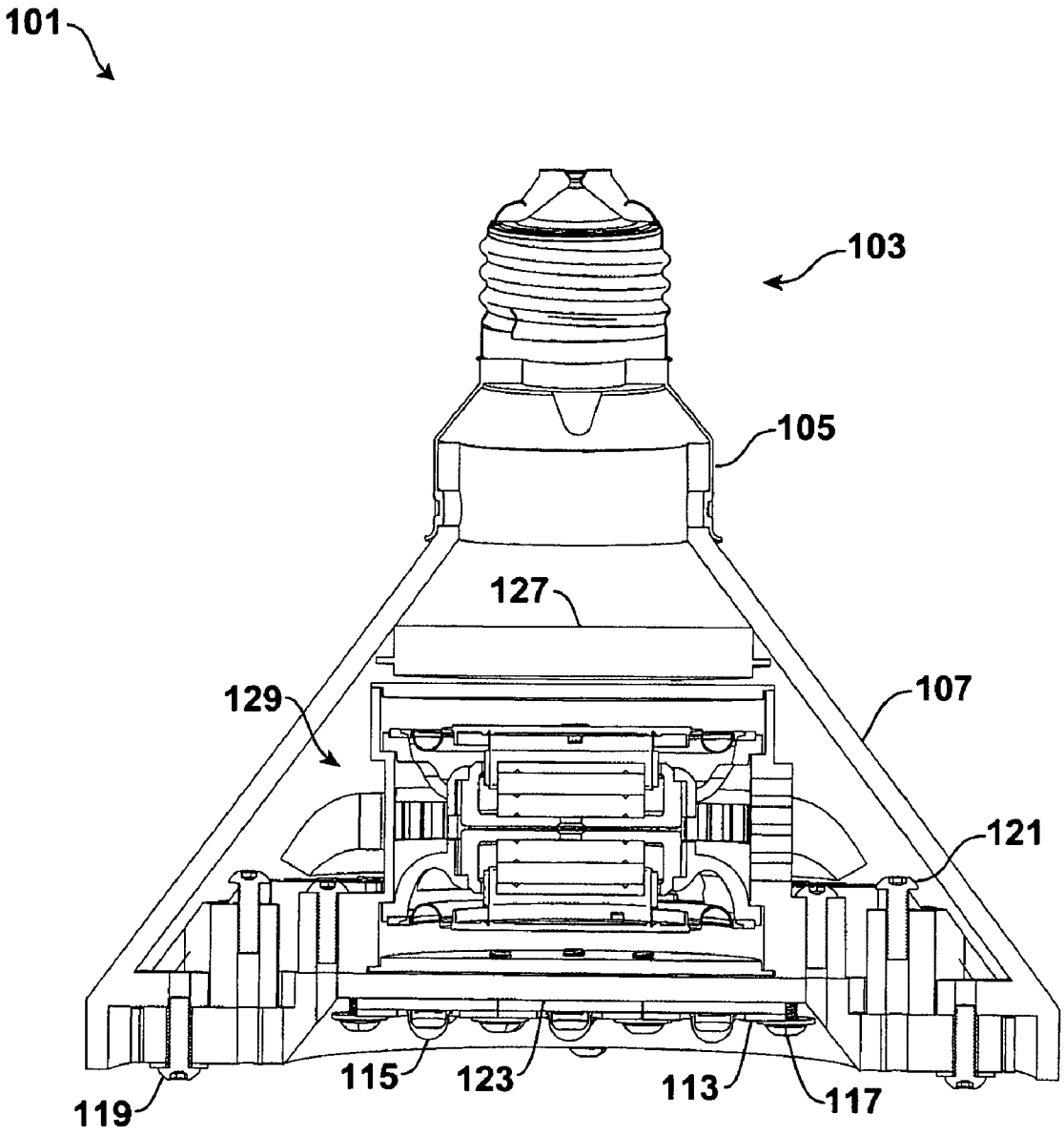
FIG. 4 is a cross-sectional view taken along LINE 4-4 of FIG. 3.
Figure 24:
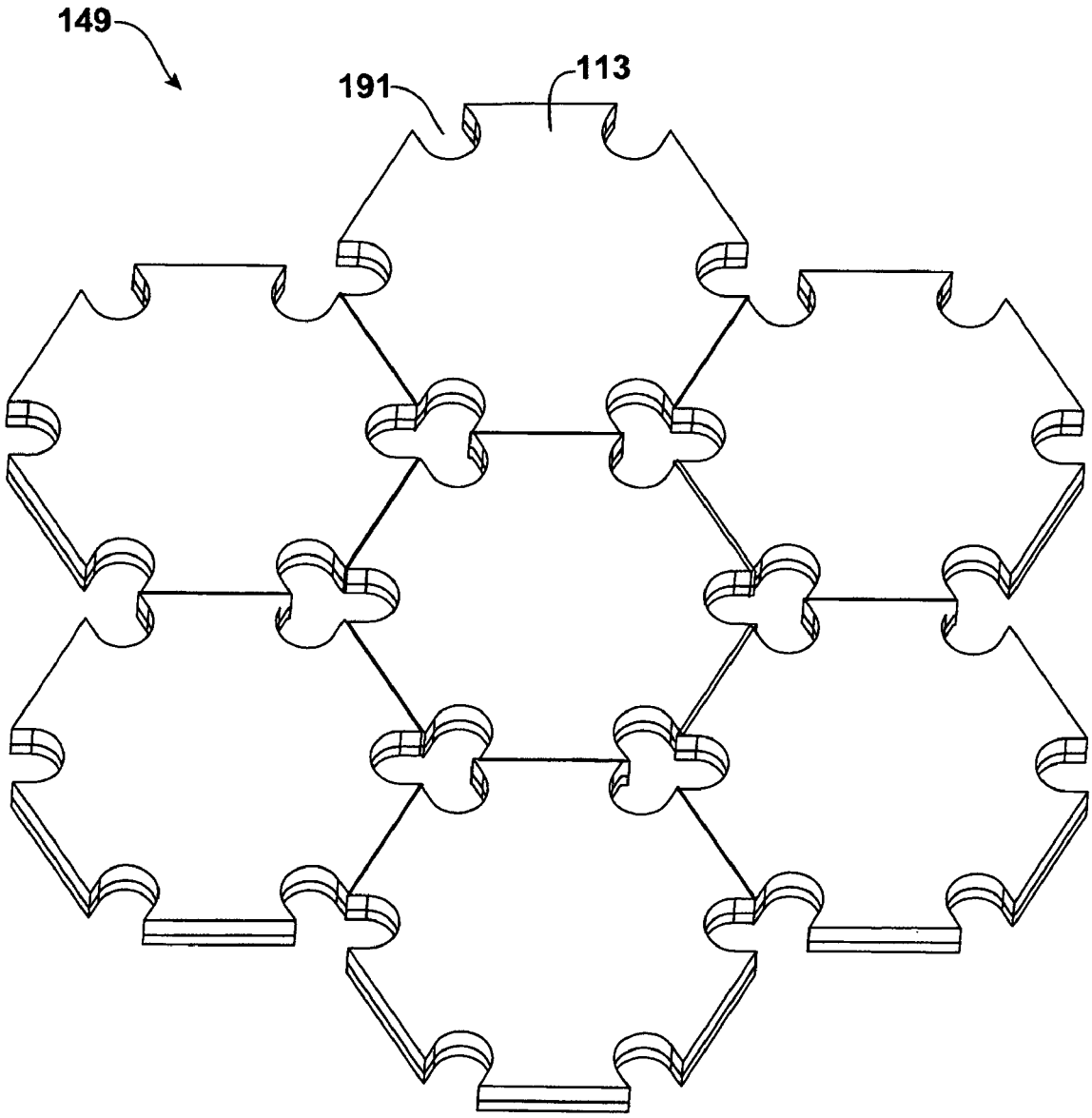
FIG. 24 is a perspective view showing the bottom of the LED die assembly of FIG. 12.
Figure 25:
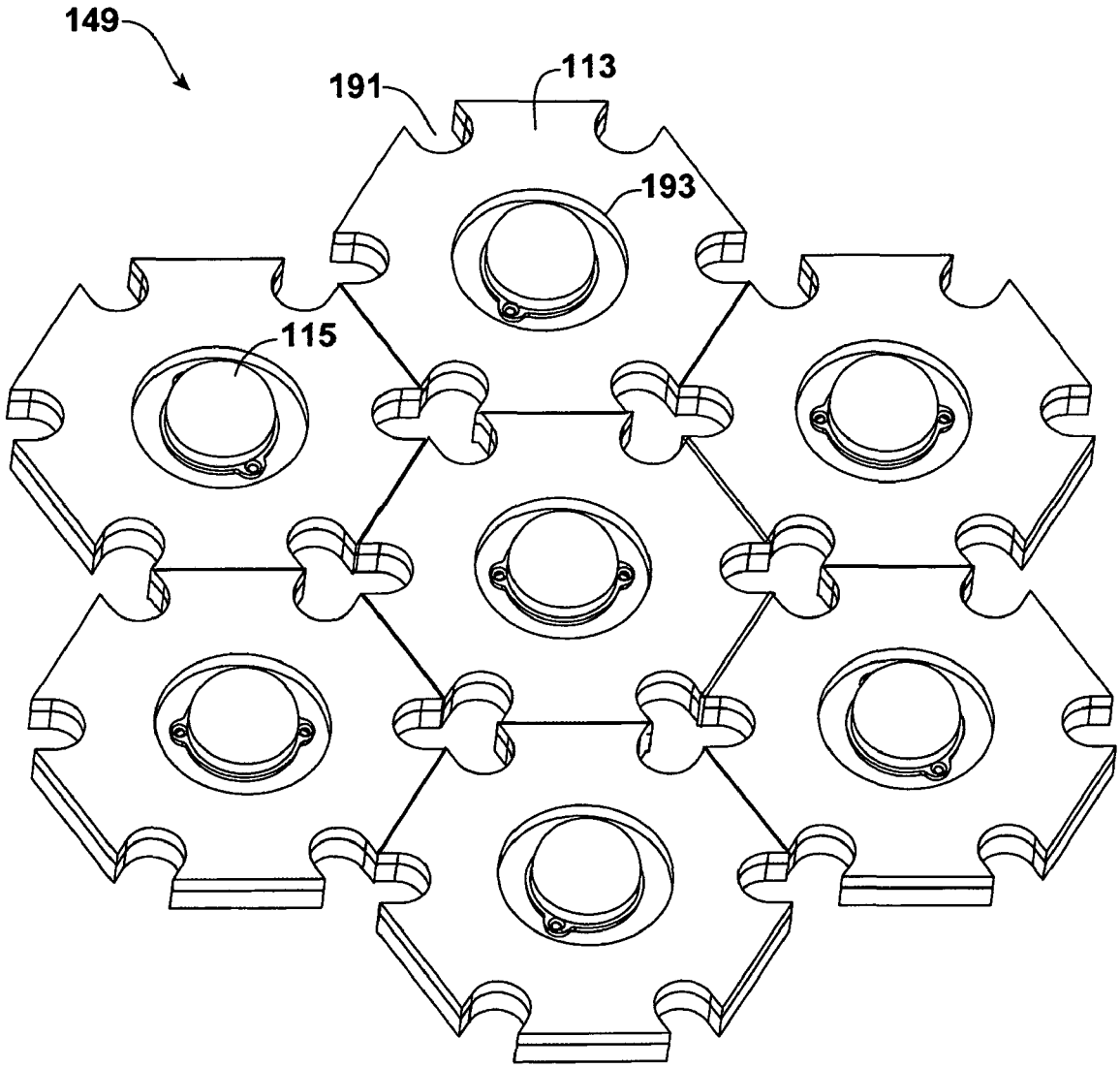
FIG. 25 is a perspective view showing the top of the LED die assembly of FIG. 12.
Figure 26:
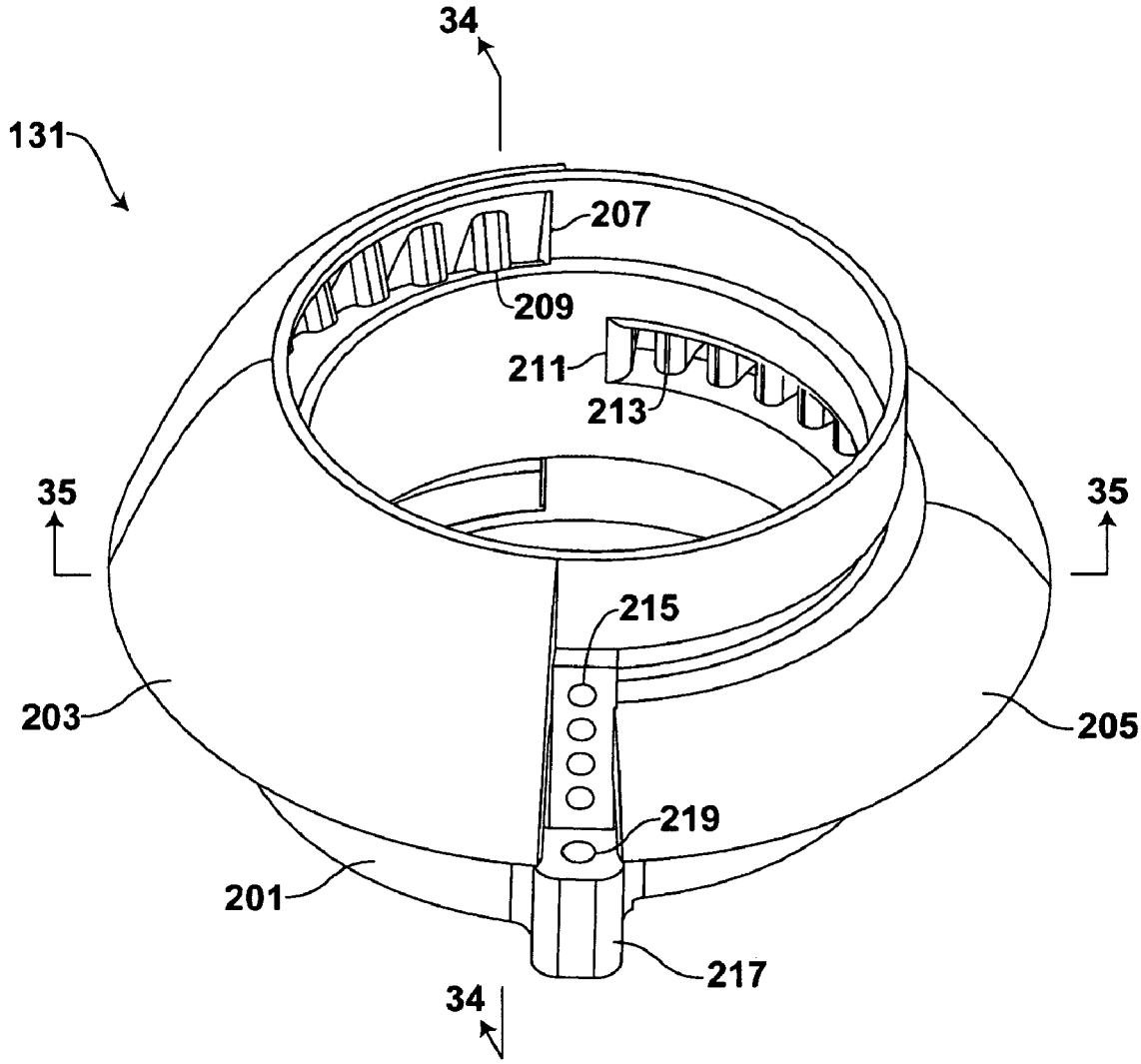
FIG. 26 is a perspective view of second flow channel element of FIG. 7.
Figure 27:
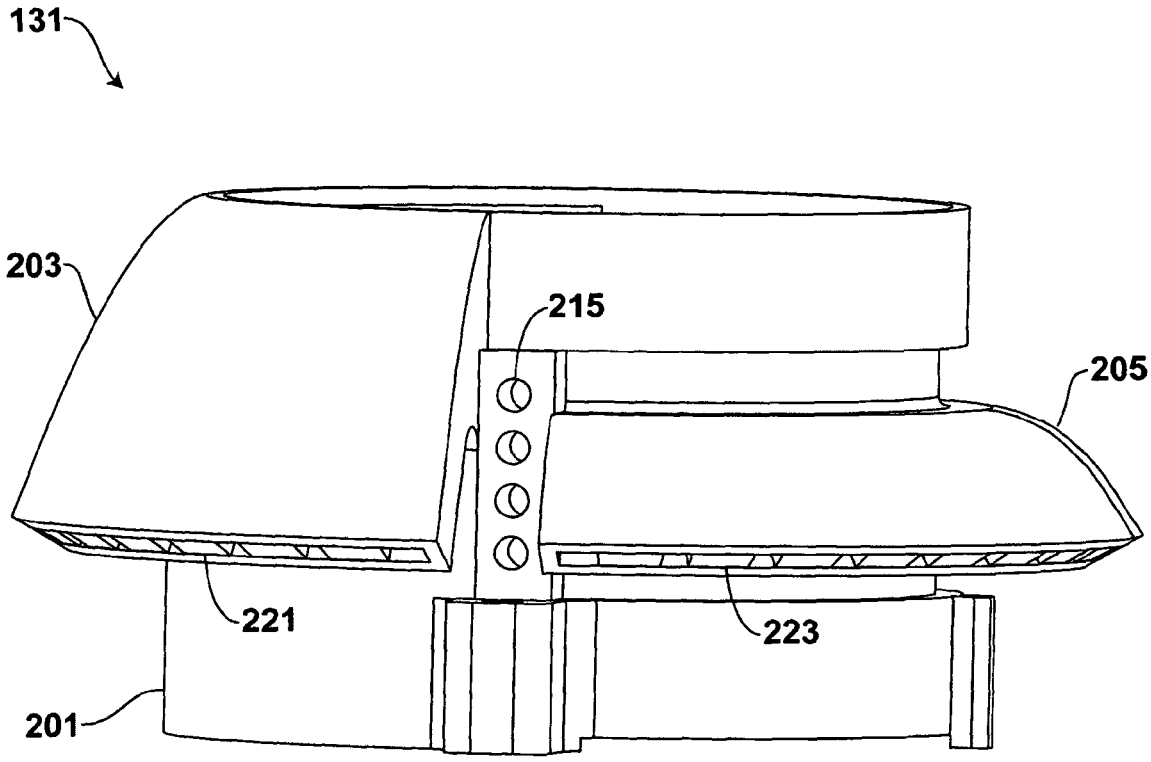
FIG. 27 is a perspective view of second flow channel element of FIG. 7.
Figure 28:
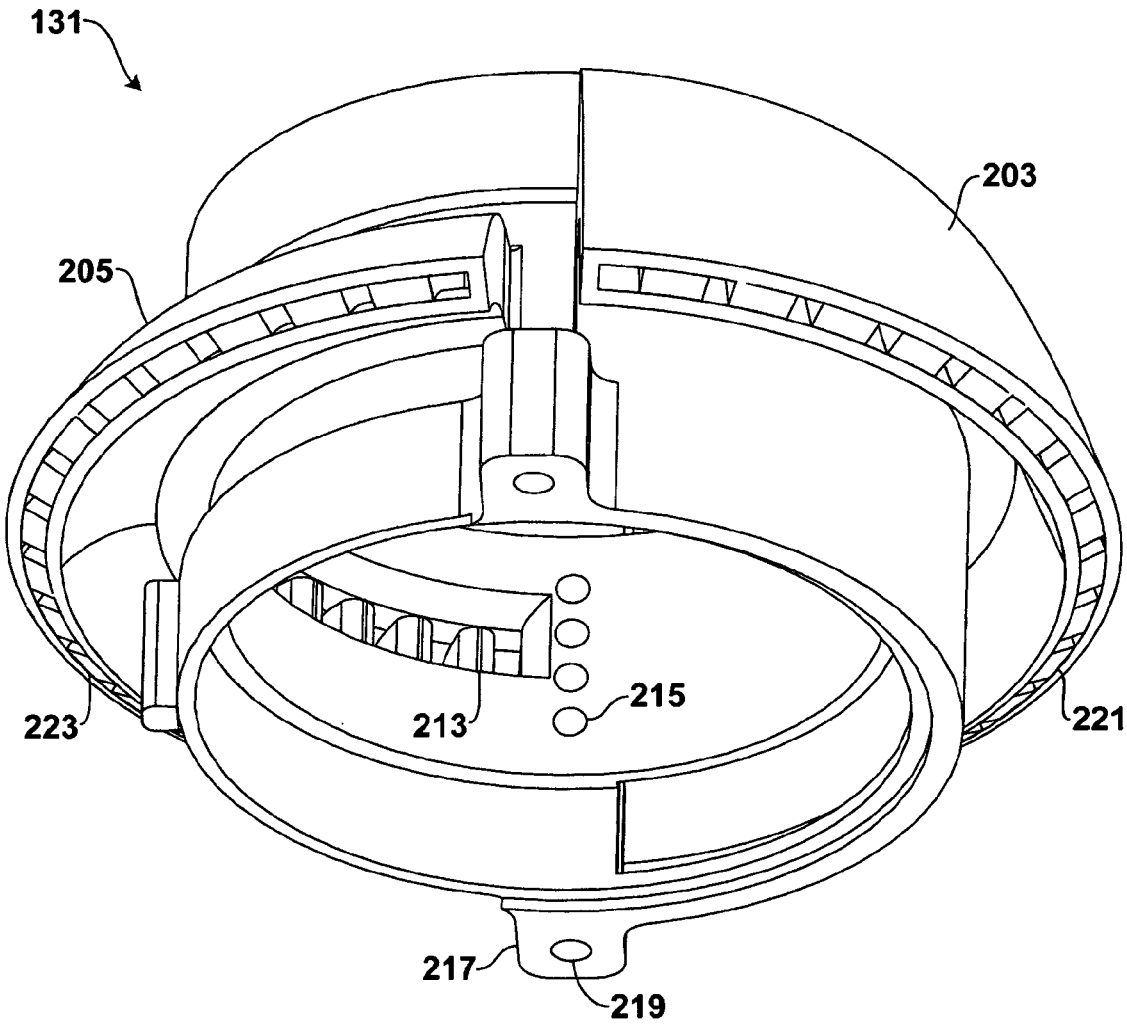
FIG. 28 is a perspective view of second flow channel element of FIG. 7.
Figure 29:
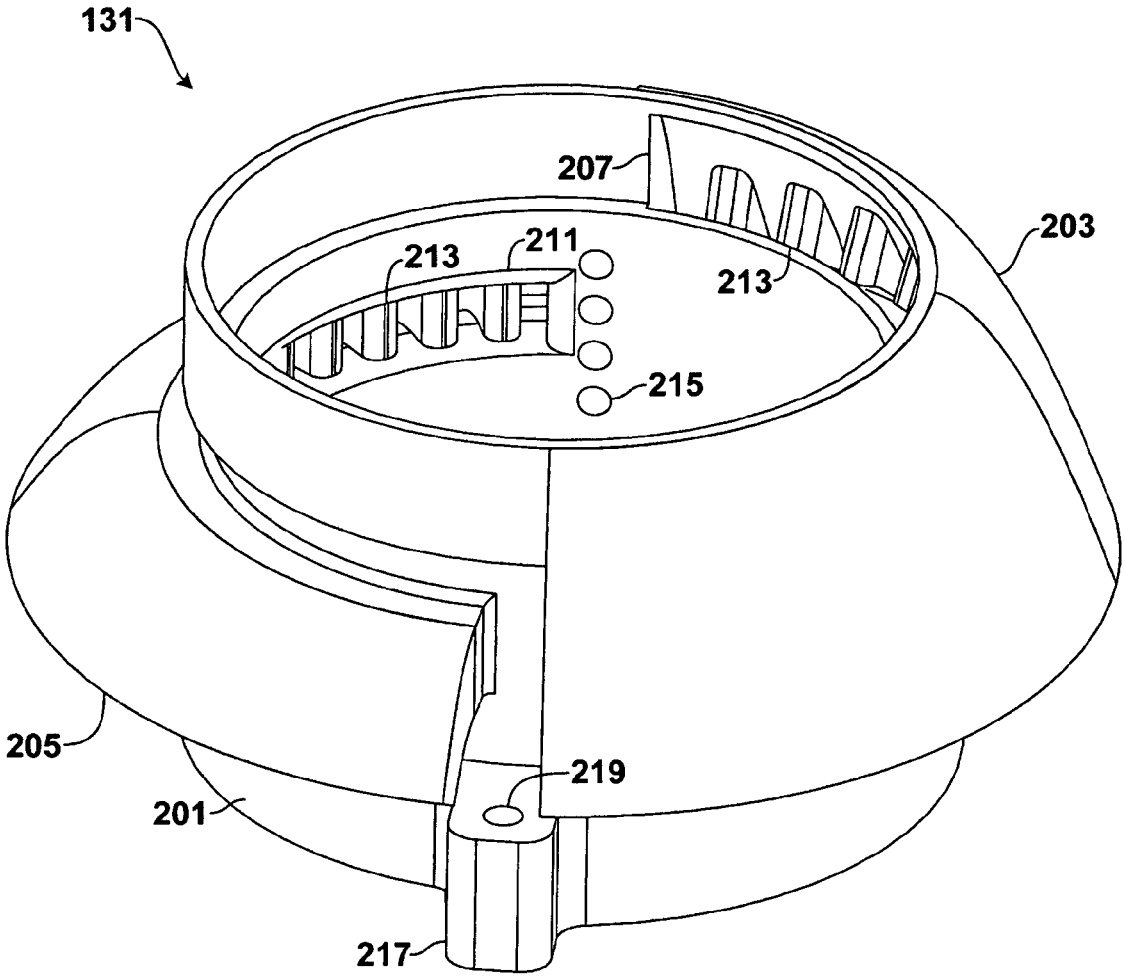
FIG. 29 is a perspective view of second flow channel element of FIG. 7.
Figure 30:
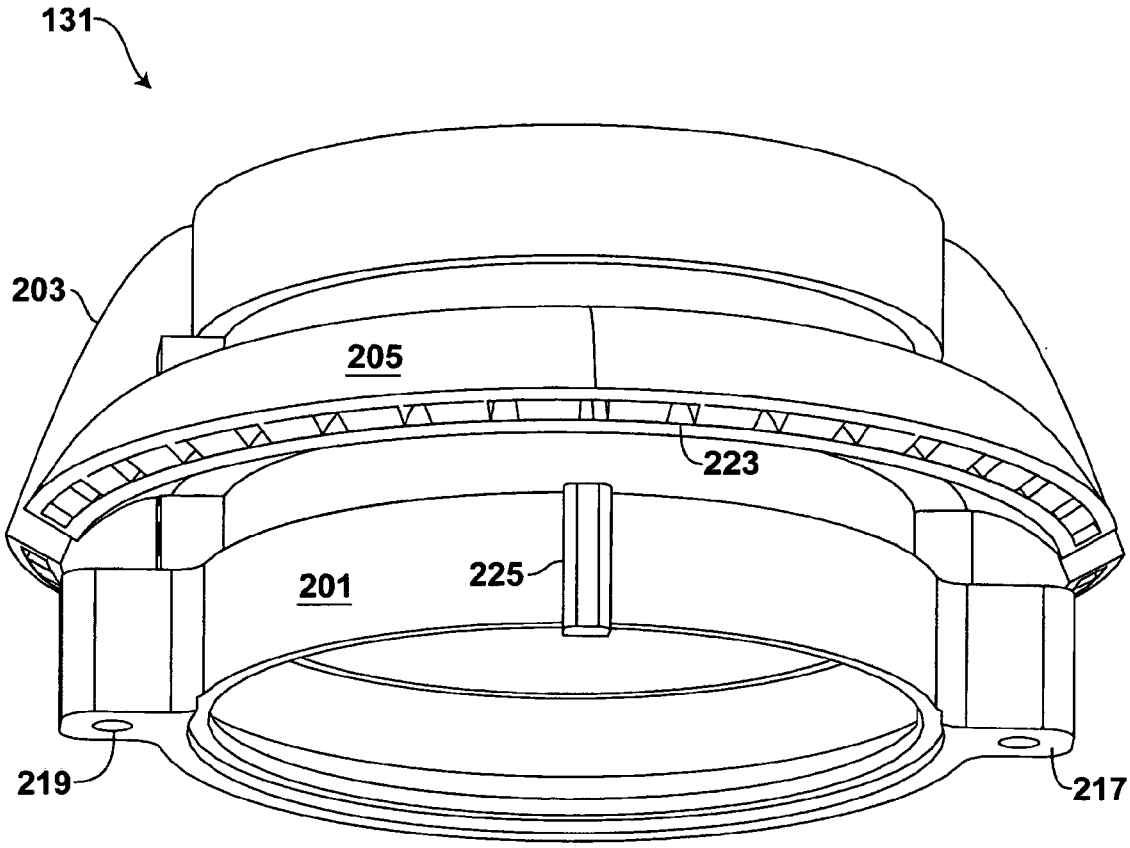
FIG. 30 is a perspective view of second flow channel element of FIG. 7.
Figure 31:
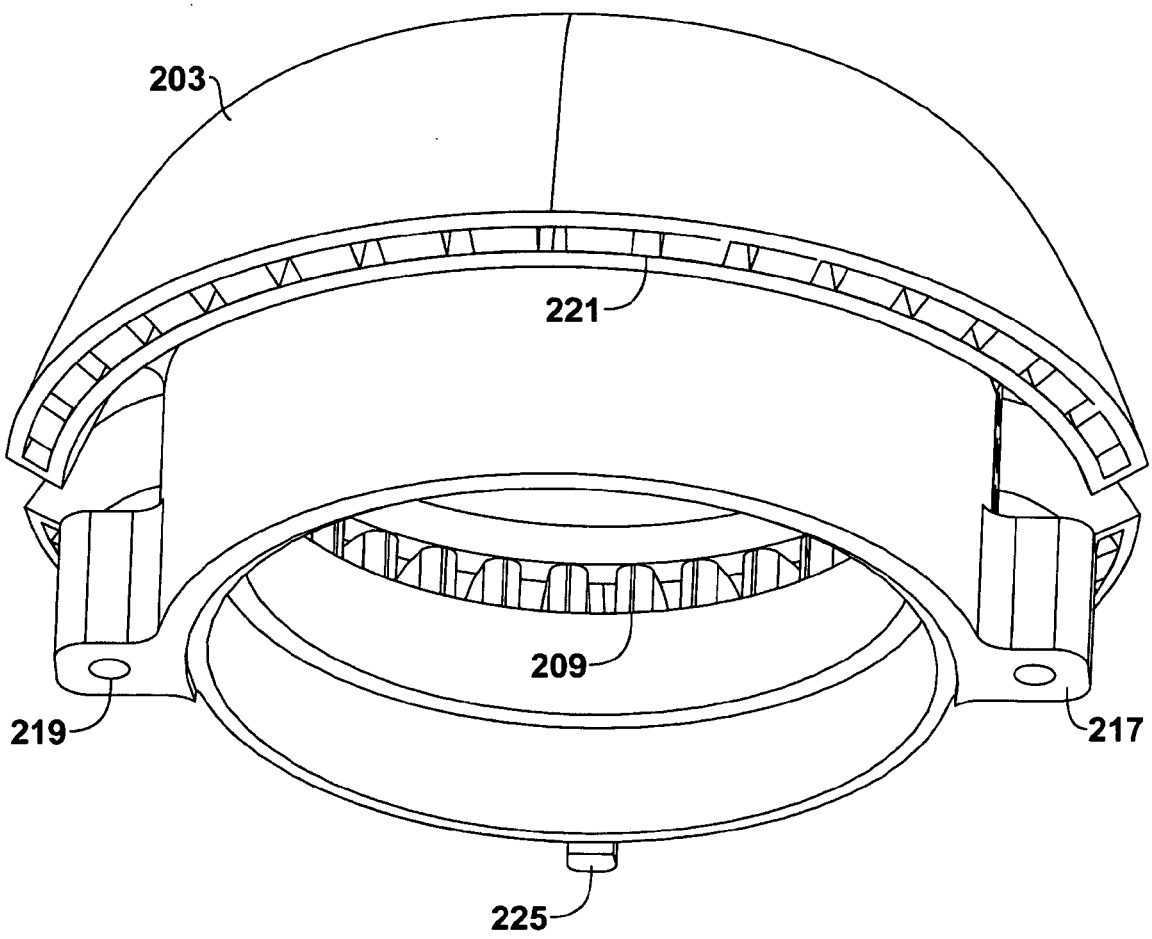
FIG. 31 is a perspective view of second flow channel element of FIG. 7.
Figure 32:
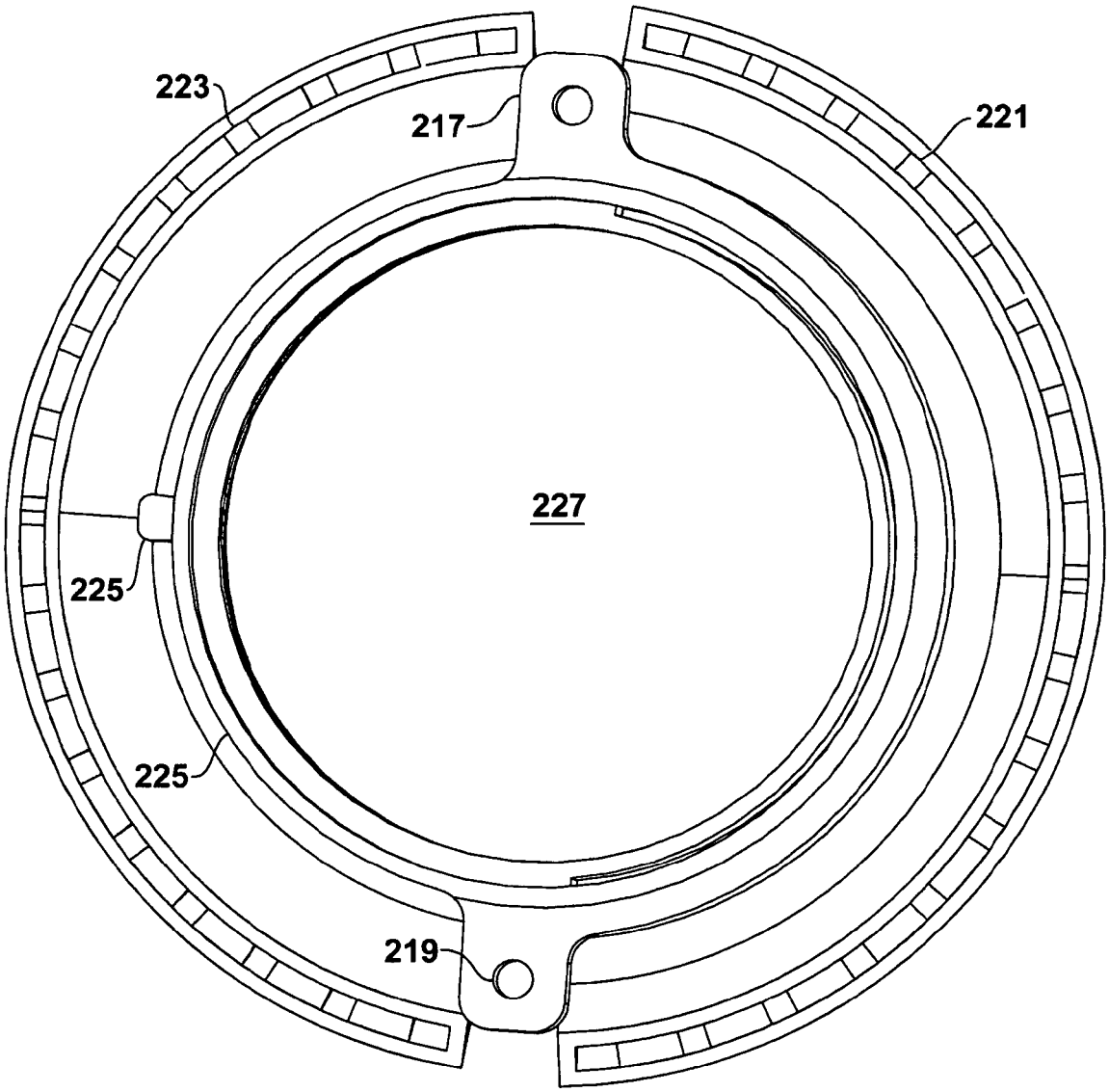
FIG. 32 is a perspective view showing the bottom of the second flow channel element of FIG. 7.
Figure 33:
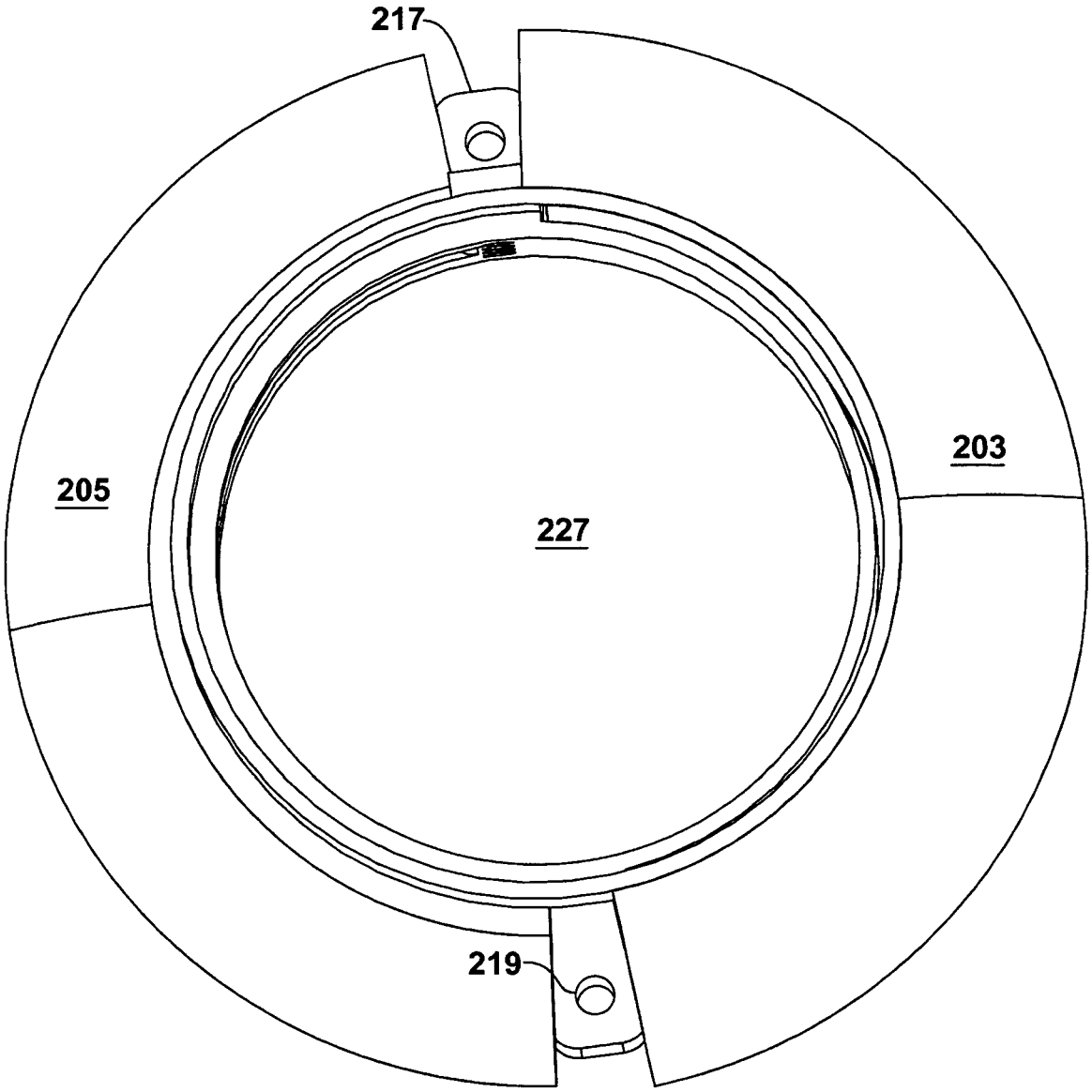
FIG. 33 is a perspective view showing the top of the second flow channel element of FIG. 7.

Referring now to FIGS. 2-3, the light-emitting portion of the light source 101 is shown in greater detail. As seen therein, a heat sink 109 is seated within the second annular portion 173 of the exterior housing element 107. The heat sink 109, which is shown in greater detail in FIGS. 15-18, has a central planar portion 123 which is bounded by an annular ridge 243 (see FIGS. 17-18), and is equipped with a plurality of essentially planar fins 165 which extend circumferentially from said annular ridge 243. An LED die assembly 149, which is shown in greater detail in FIGS. 24-25, is seated on the central planar portion 123 of said heat sink 109.

With reference now to FIGS. 7-8 and 10-12, thermal management of the light source 101 is provided by way of a dual actuator assembly 147 which is housed within a second flow channel element 131. The second flow channel element 131 is shown in greater detail in FIGS. 26-35. As seen therein, the second flow channel element 131 is equipped with a central cylindrical opening 227 within which the dual actuator assembly 147 is disposed. The body of the second flow channel element 131 is equipped with a first opening 207 and a second opening 211 which contained dividers 209 and 213, respectively. The first 207 and second 211 openings have a plurality of channels 221 and 223 defined therein by dividers 209 and 213 and buy hoods 203 and 205, respectively.

Figure 5:
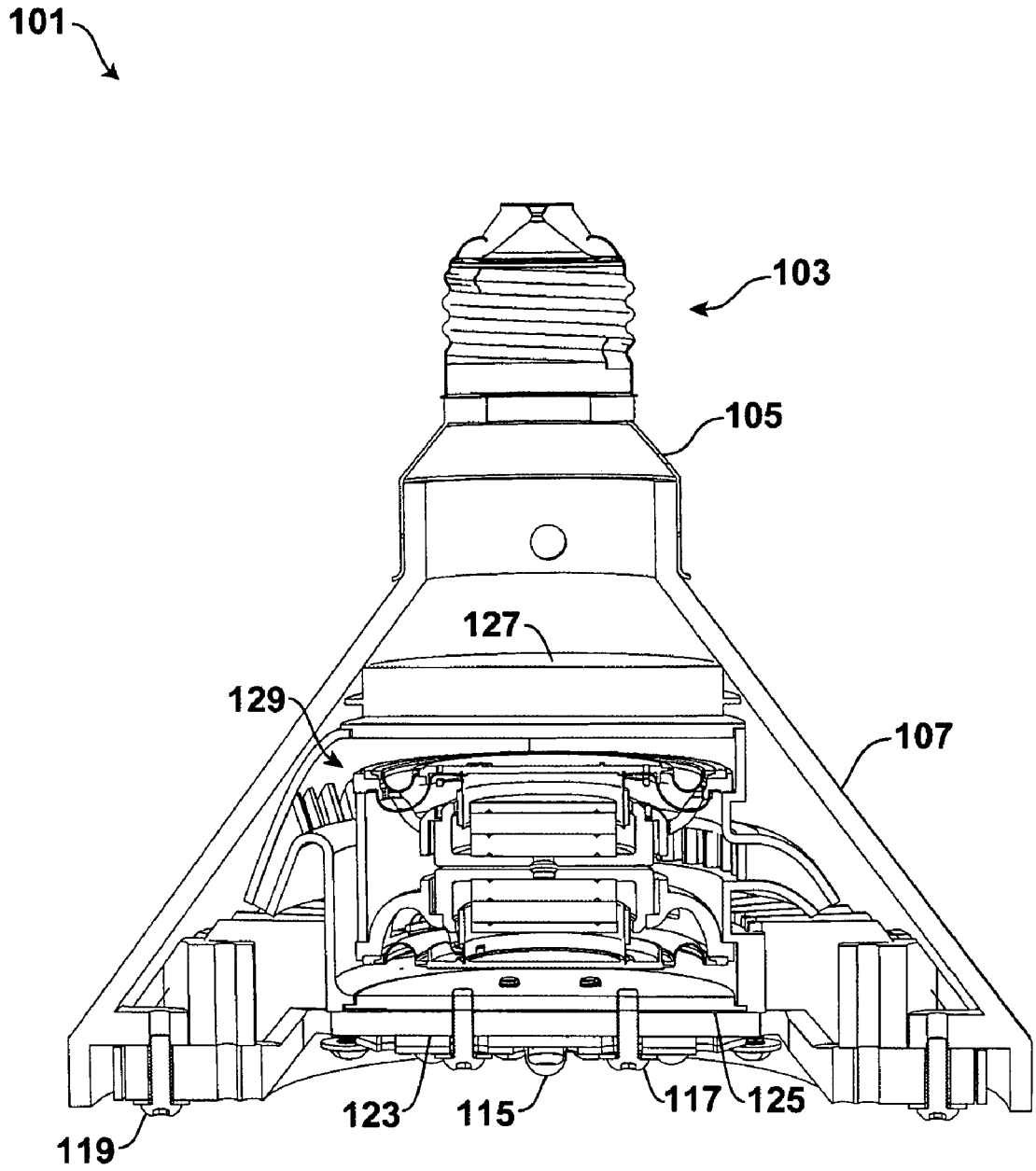
FIG. 5 is a cross-sectional view taken along LINE 5-5 of FIG. 3.
Figure 6:
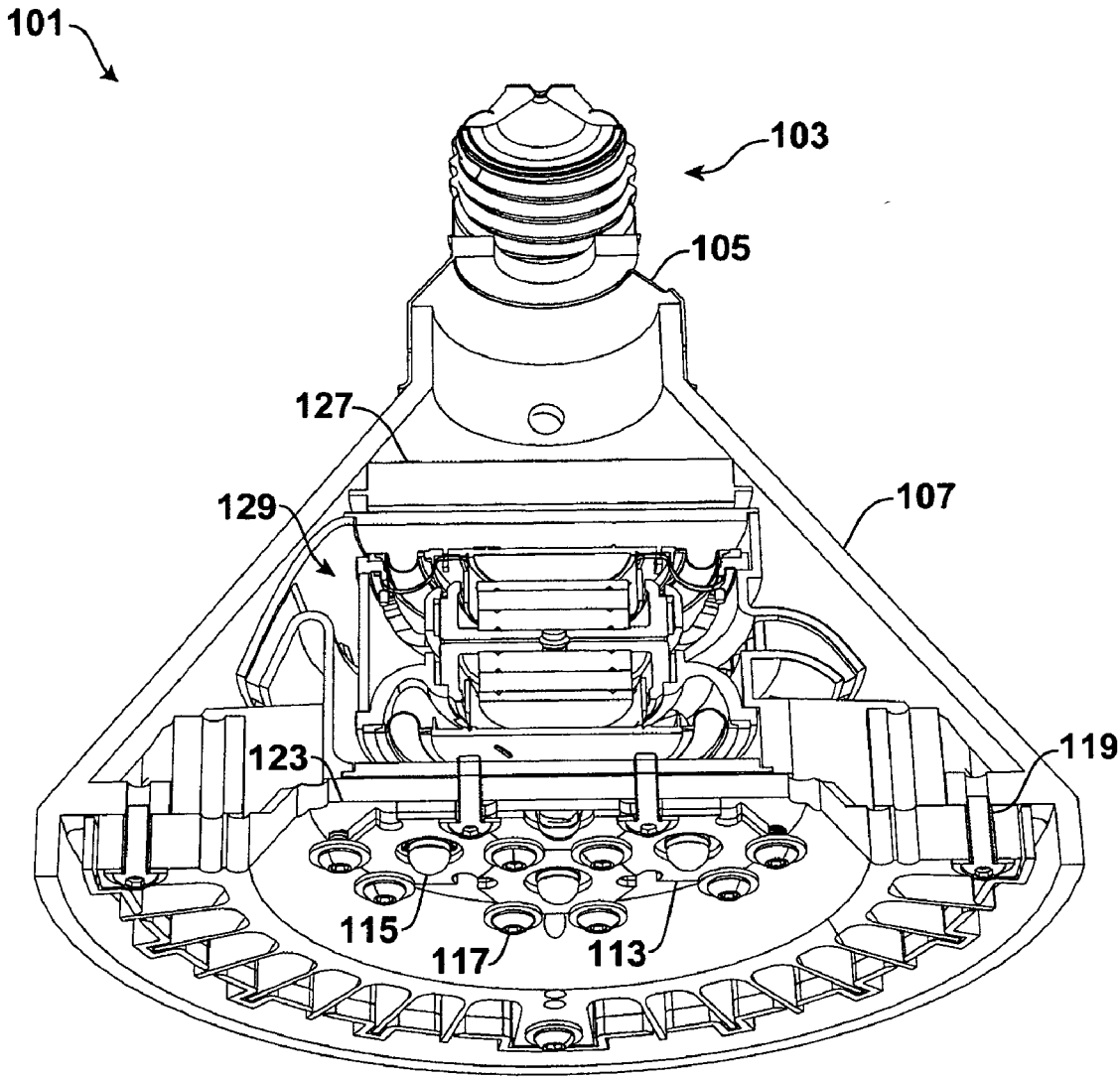
FIG. 6 is a view of FIG. 5 tilted along an axis perpendicular to the longitudinal axis of the light source.
Figure 7:
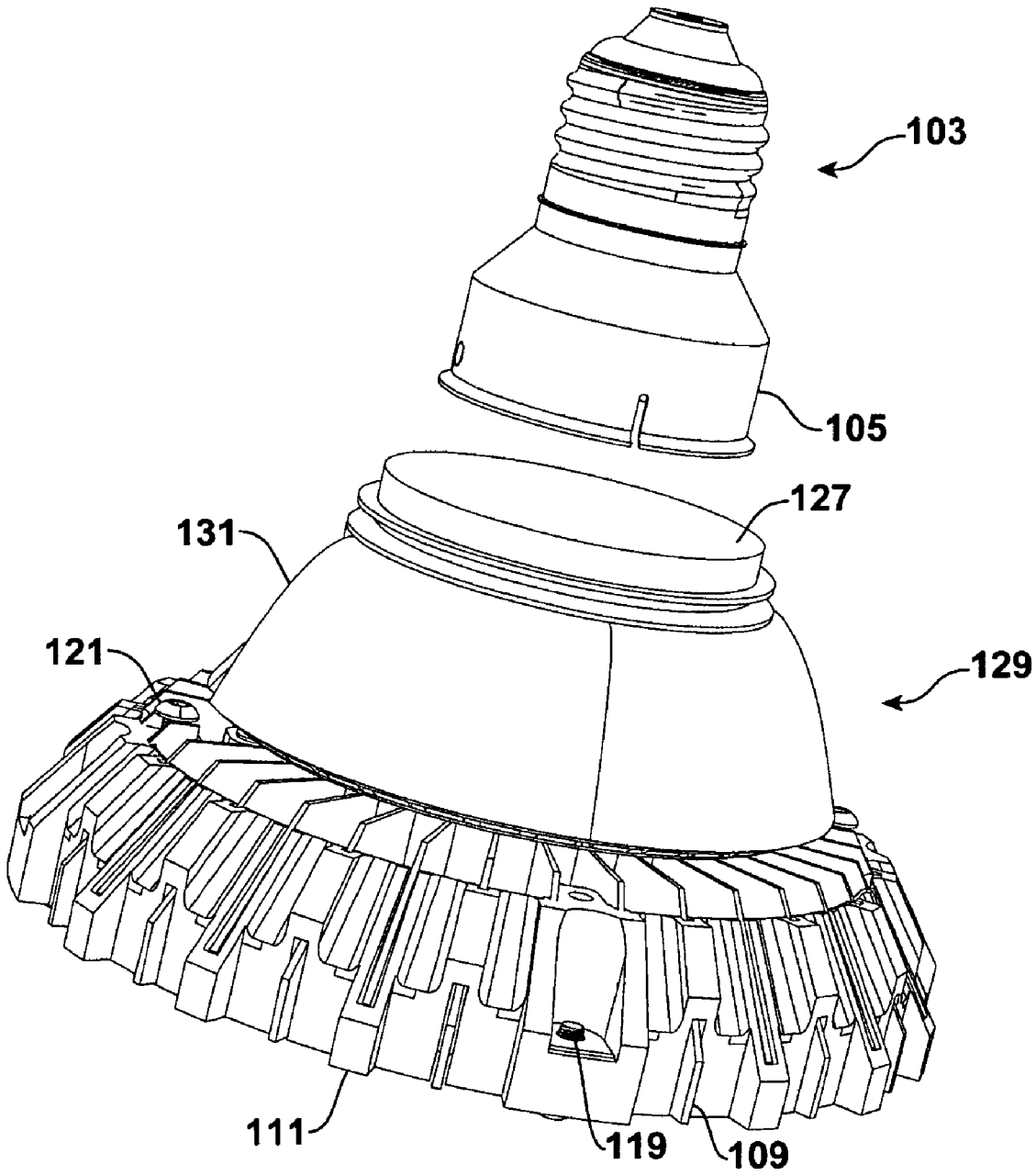
FIG. 7 is a view of FIG. 1 with the exterior housing element removed.
Figure 8:
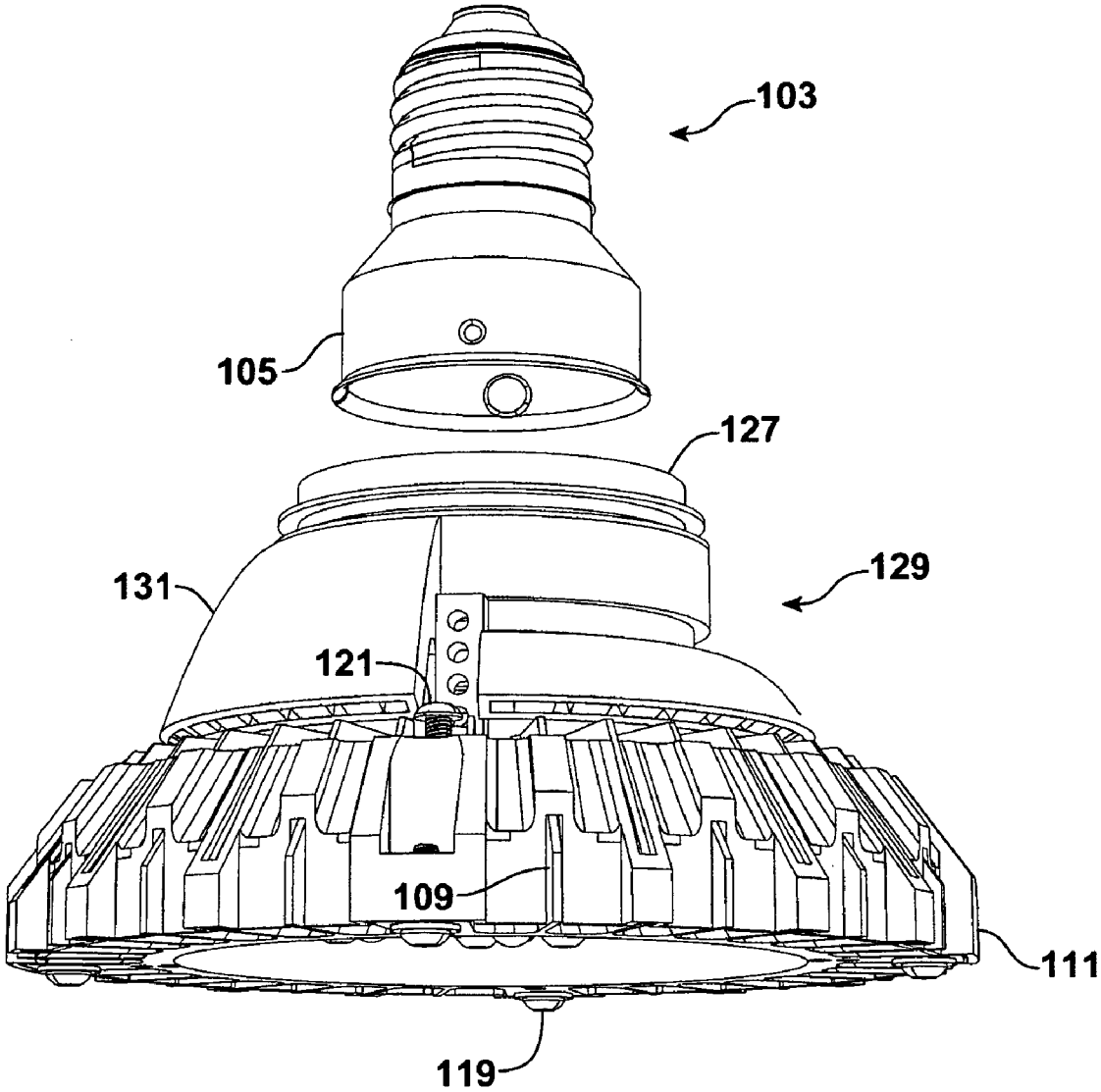
FIG. 8 is a view of FIG. 7 from a different perspective.
Figure 9:
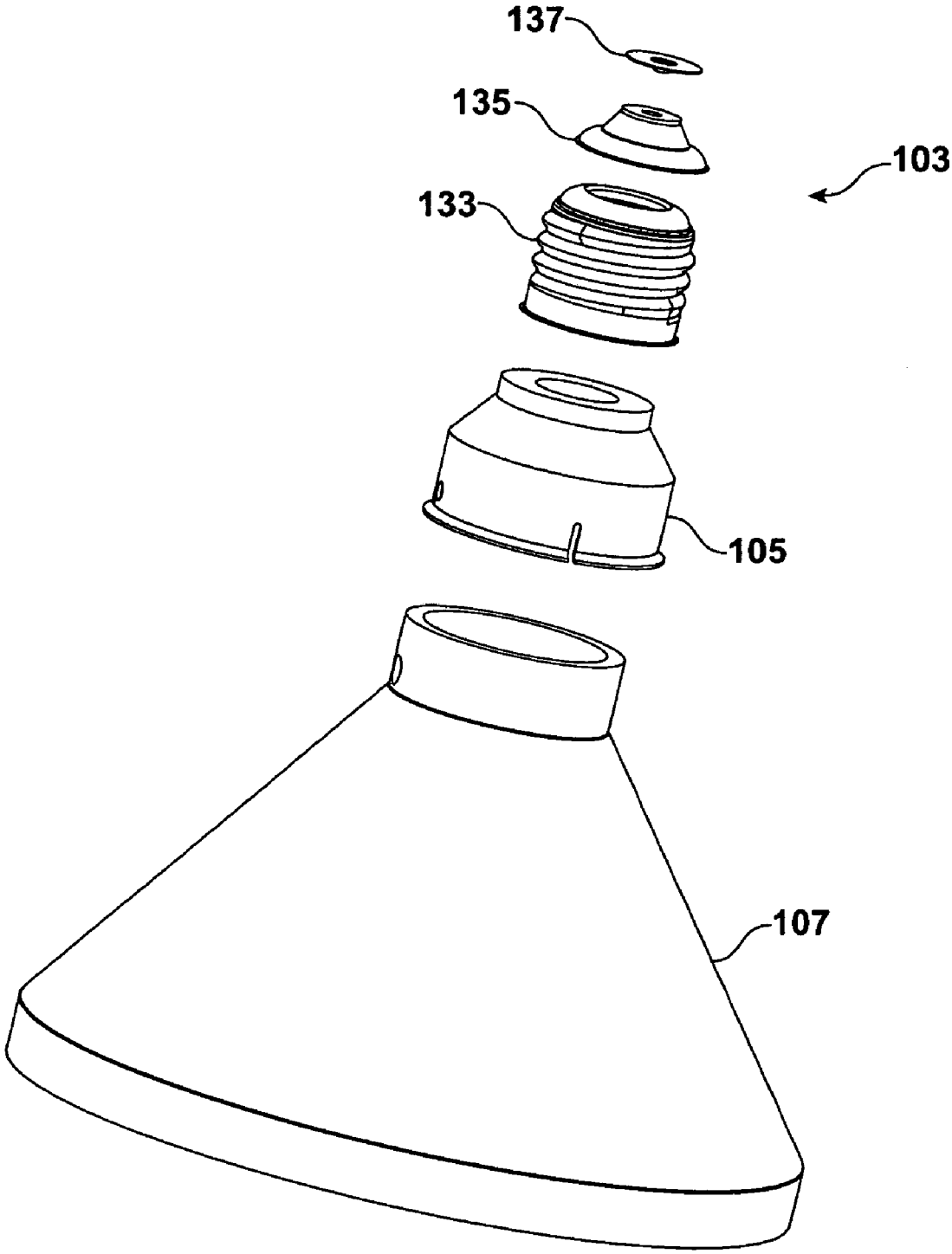
FIG. 9 is an exploded view showing the exterior housing element, adapter, and electrical contact module.
Figure 10:
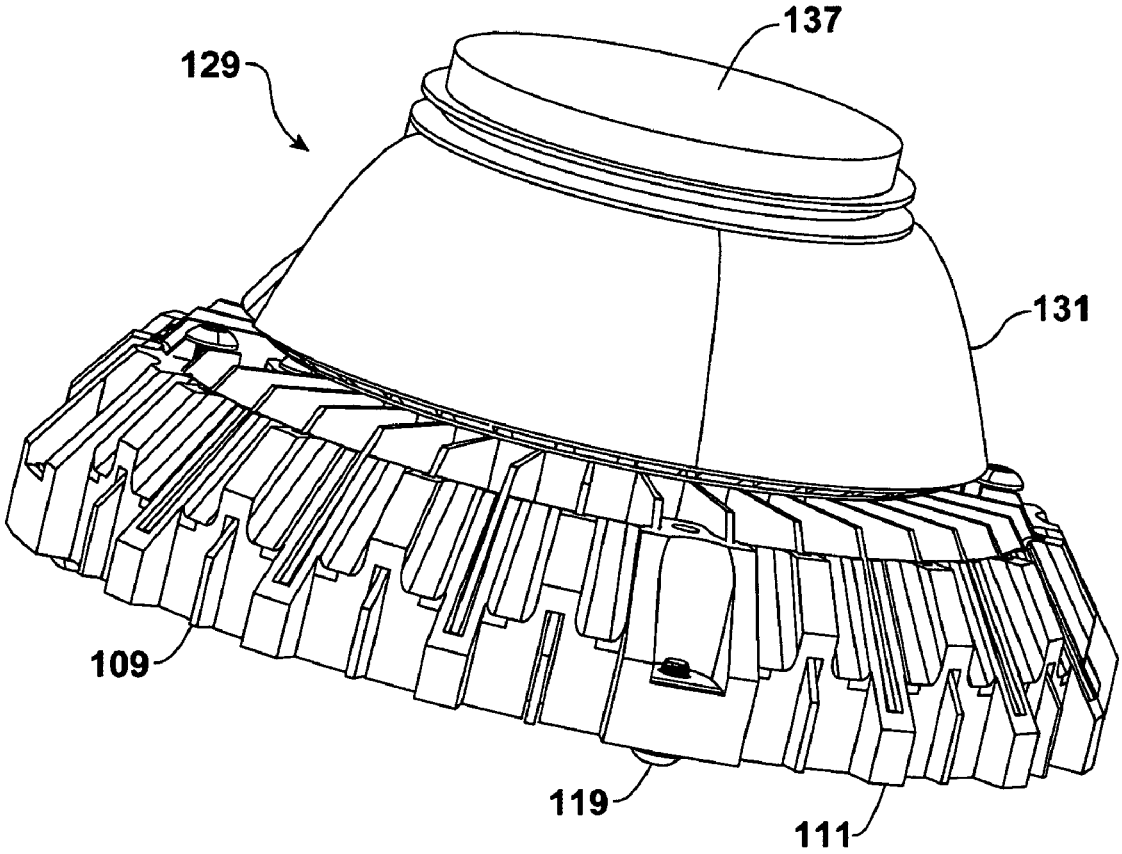
FIG. 10 is a view of FIG. 1 with the exterior housing element, adapter and electrical contact module removed.
Figure 11:
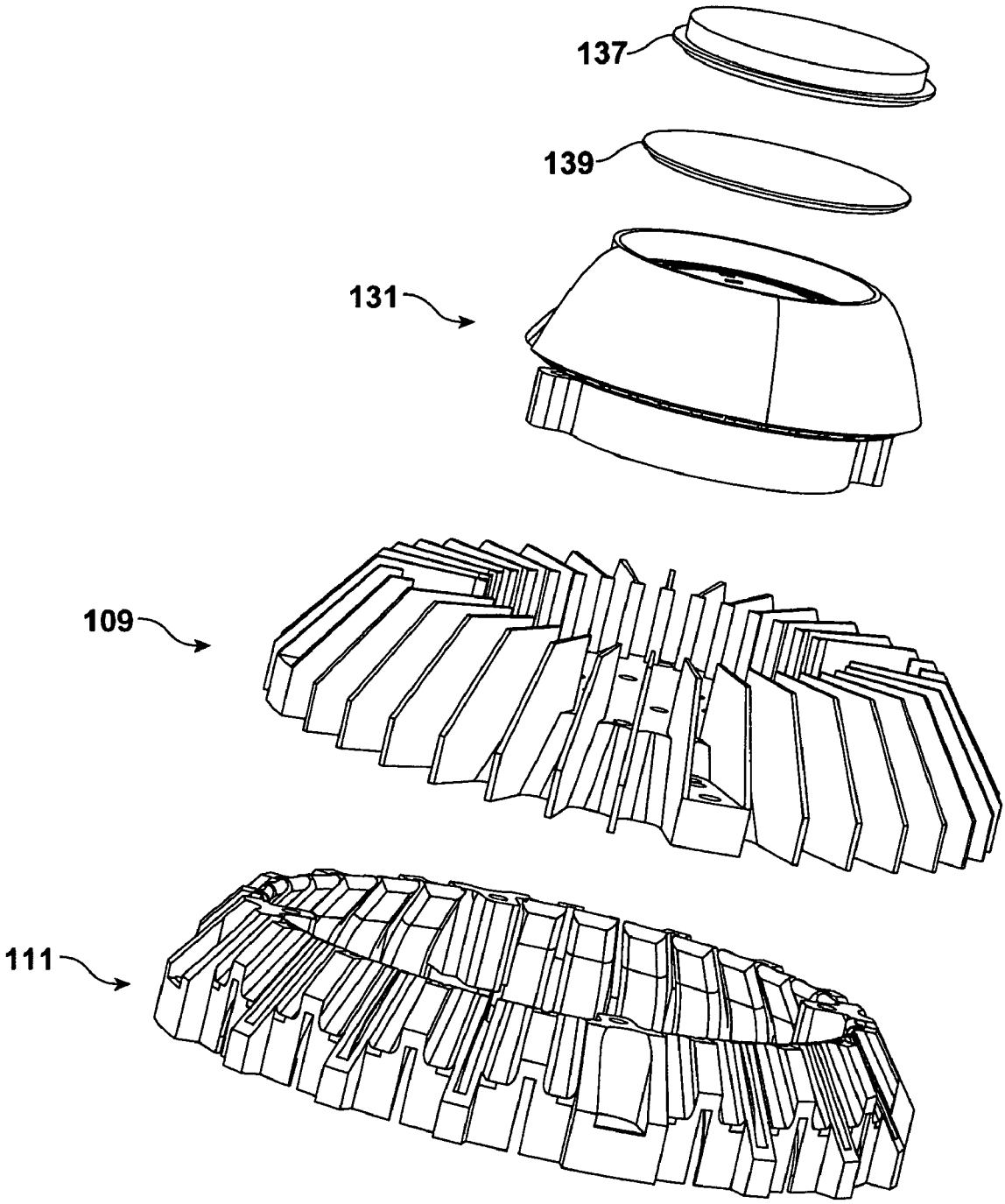
FIG. 11 is an exploded view of FIG. 10.
Figure 12:
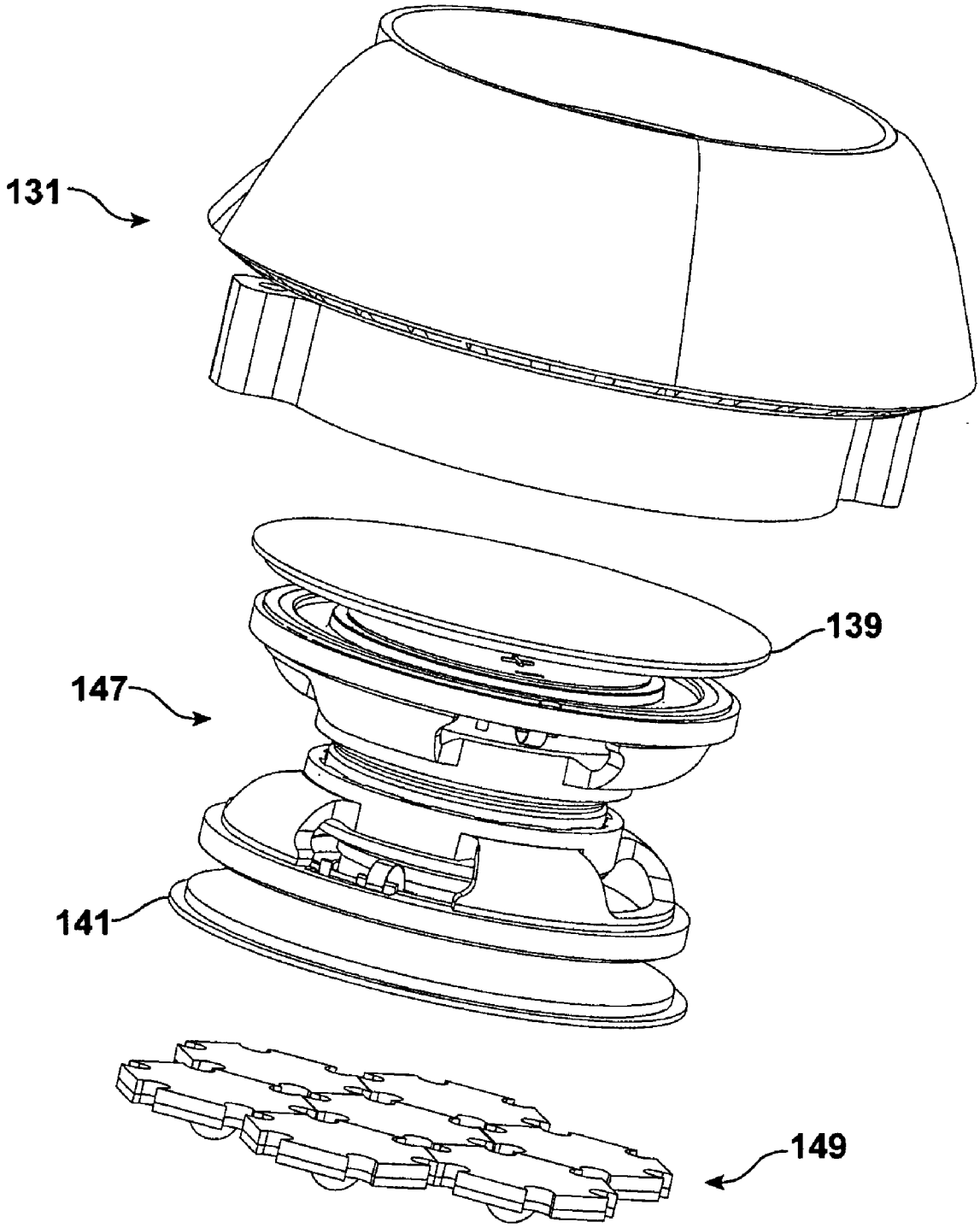
FIG. 12 is an exploded view of FIG. 10 with the first flow channel element and the heat sink removed.
Figure 13:
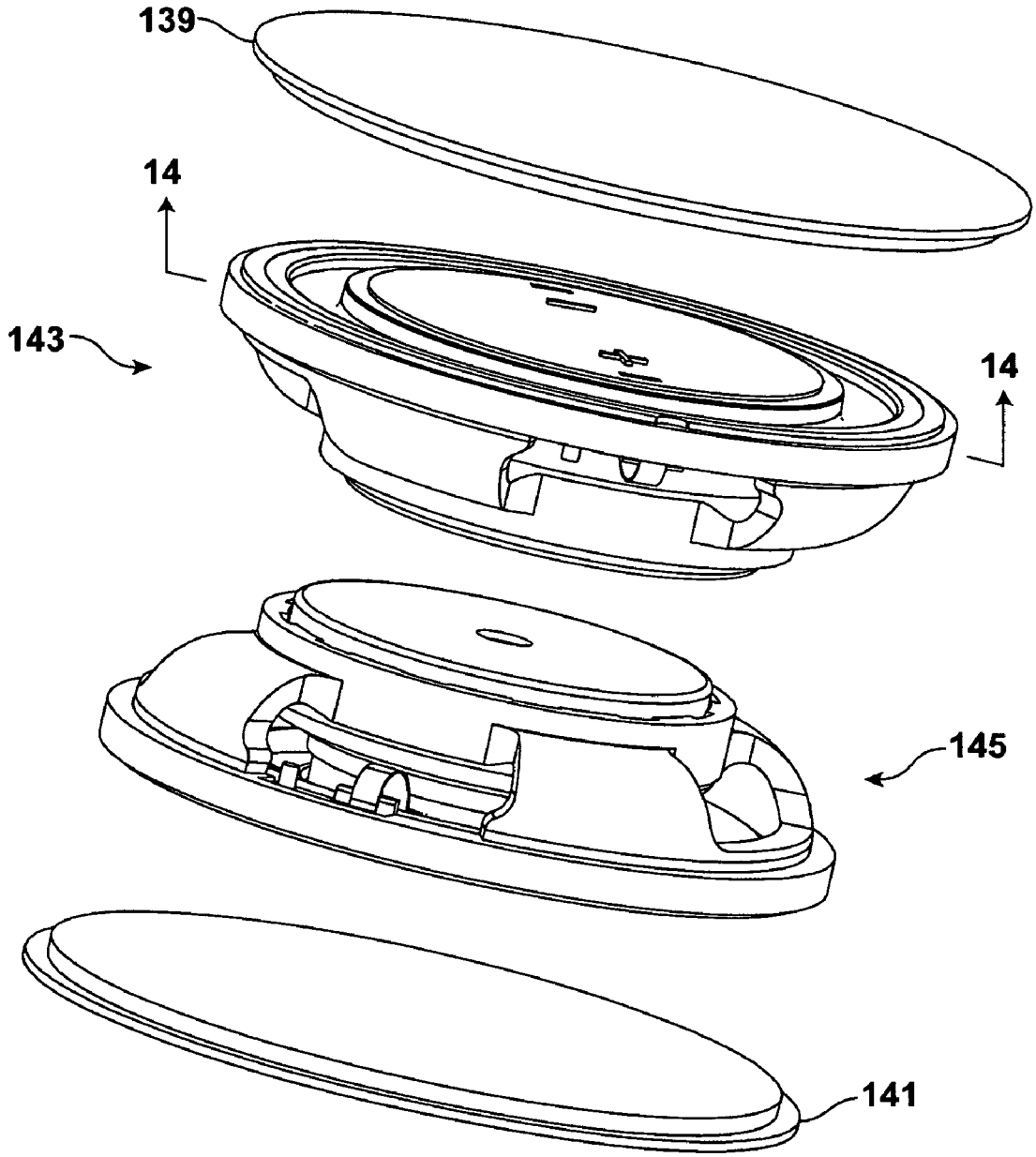
FIG. 13 is a close-up view of the dual actuator assembly of FIG. 12.
Figure 14:
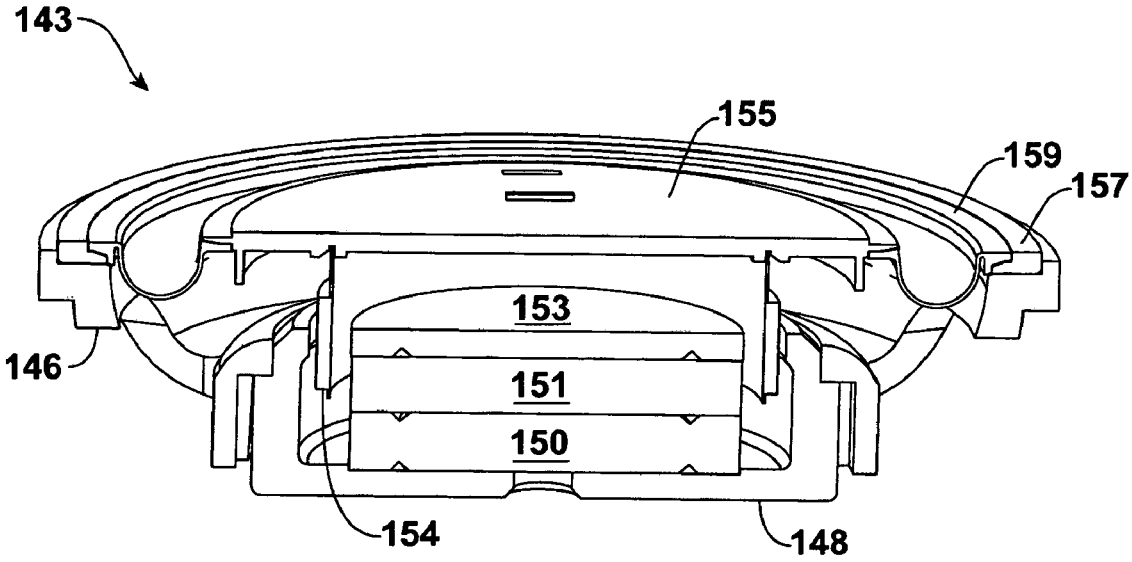
FIG. 14 is a cross-sectional view of the first actuator of FIG. 13 taken along LINE 14-14.
Figure 15:
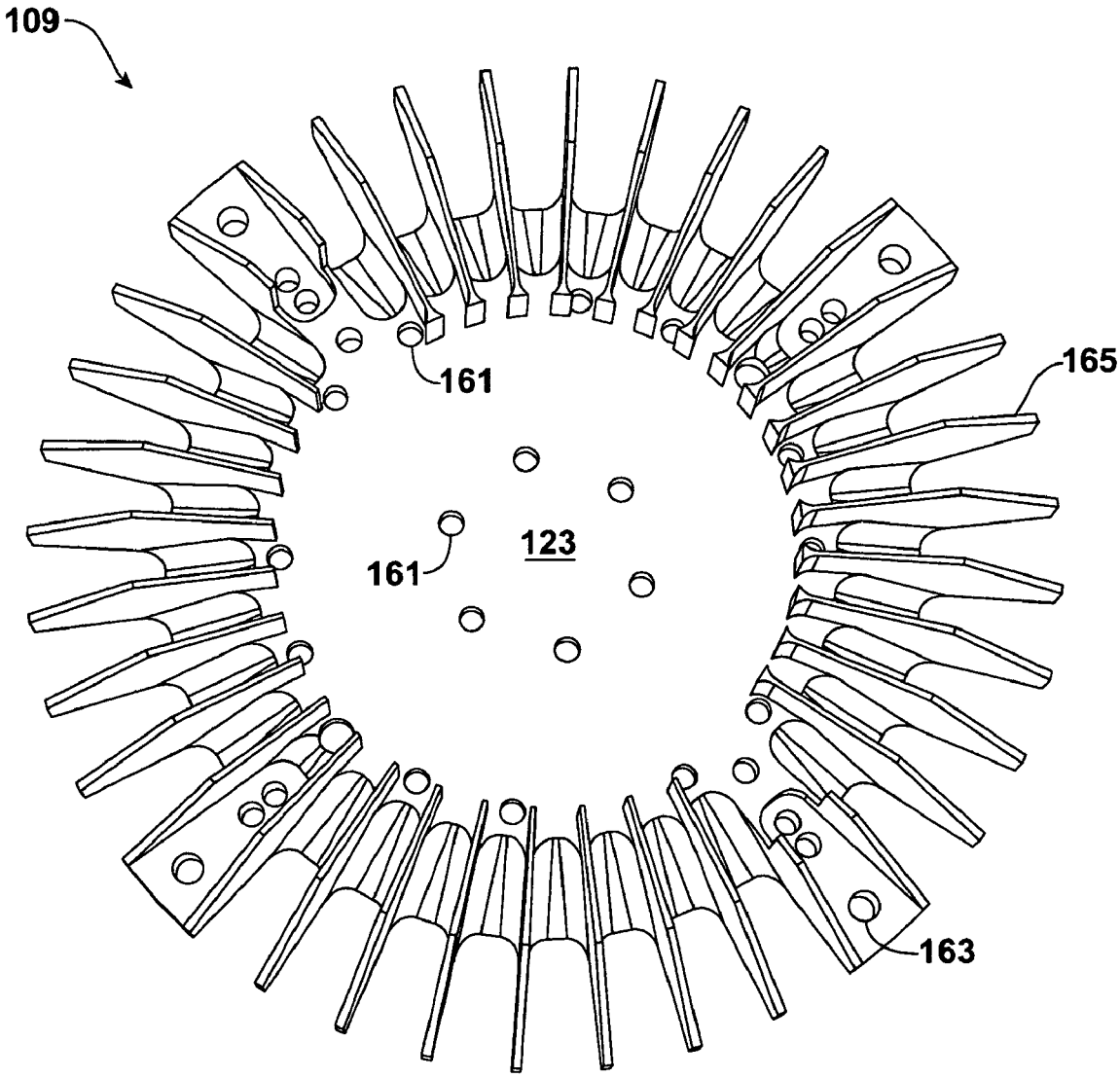
FIG. 15 is a top view of the heat sink of FIG. 11.
Figure 16:
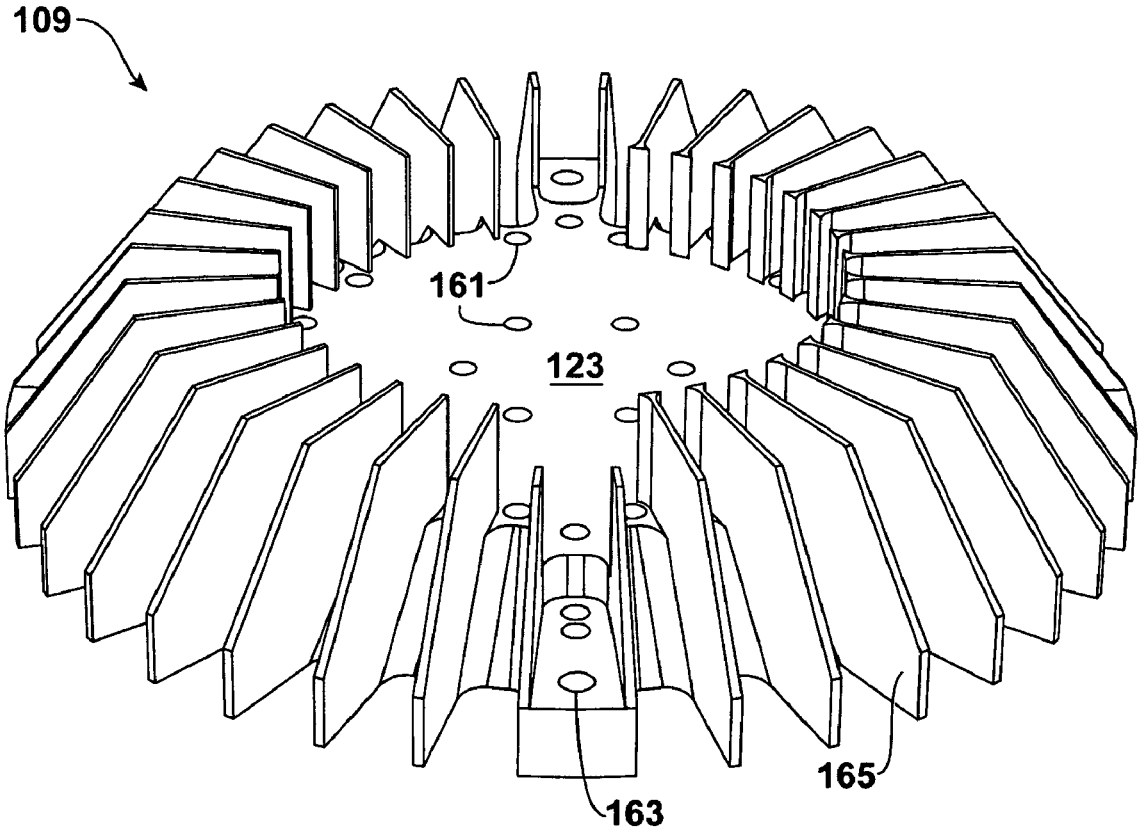
FIG. 16 is a perspective view of the heat sink of FIG. 11.
Figure 17:
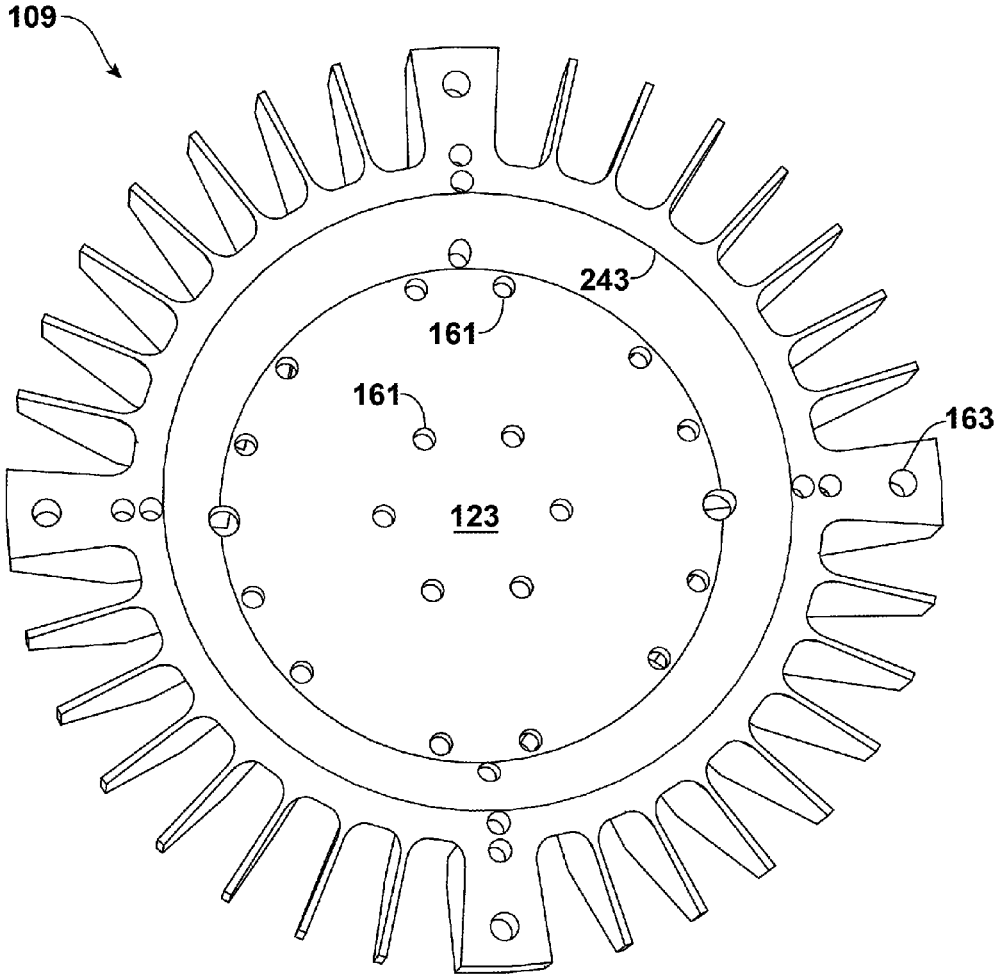
FIG. 17 is a perspective view of the bottom of the heat sink of FIG. 11.
Figure 18:
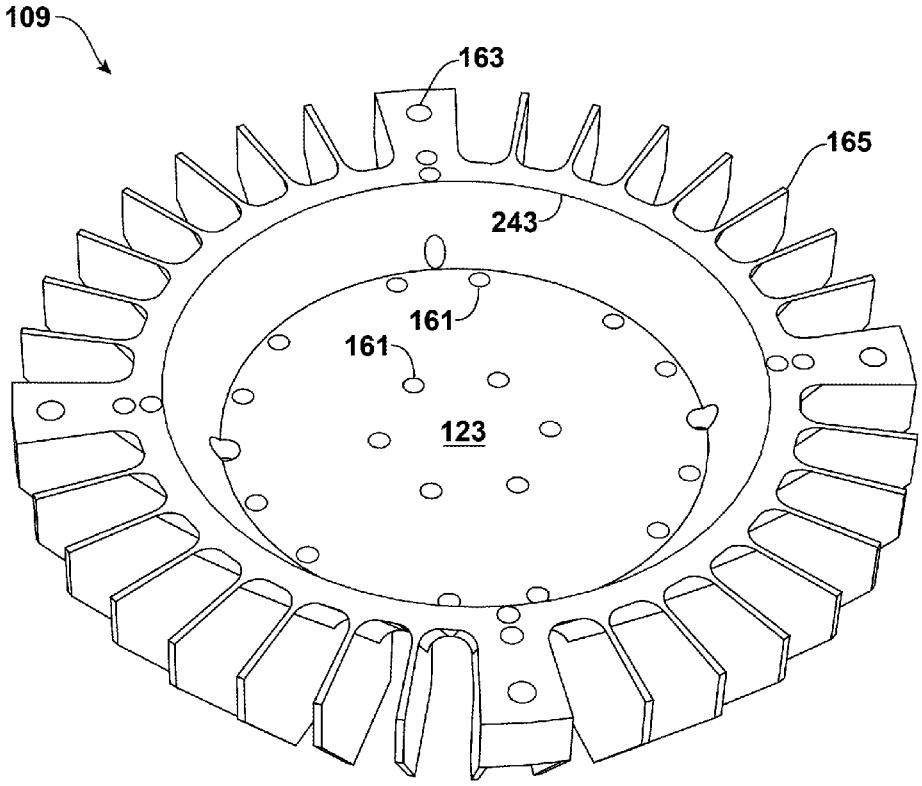
FIG. 18 is a perspective view of the bottom of the heat sink of FIG. 11.
Figure 34:
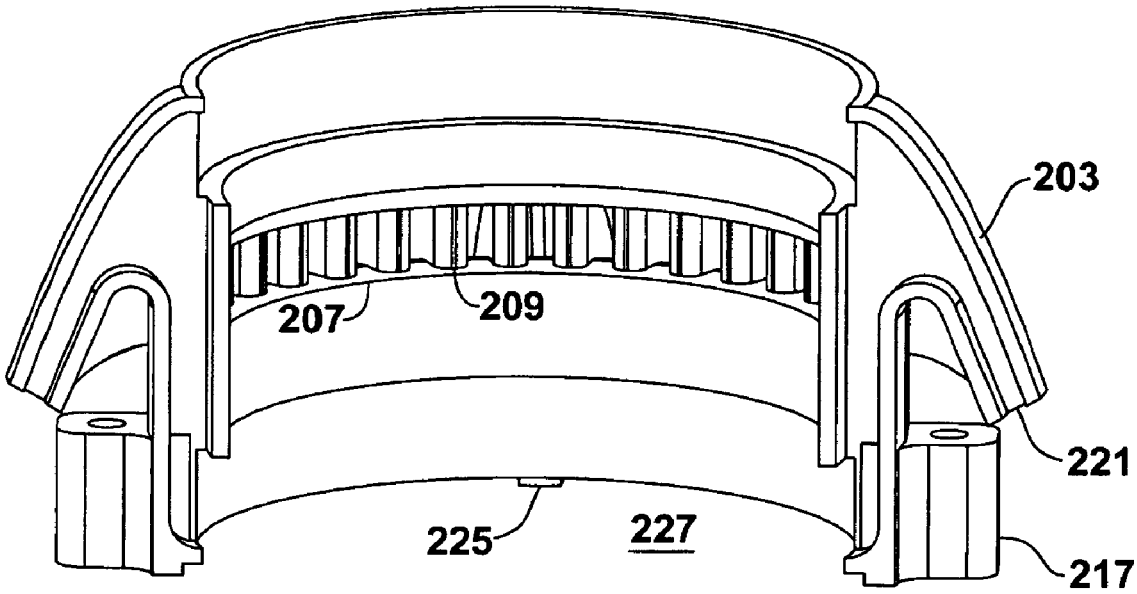
FIG. 34 is a cross-sectional view taken along LINE 34-34 of FIG. 26.
Figure 35:
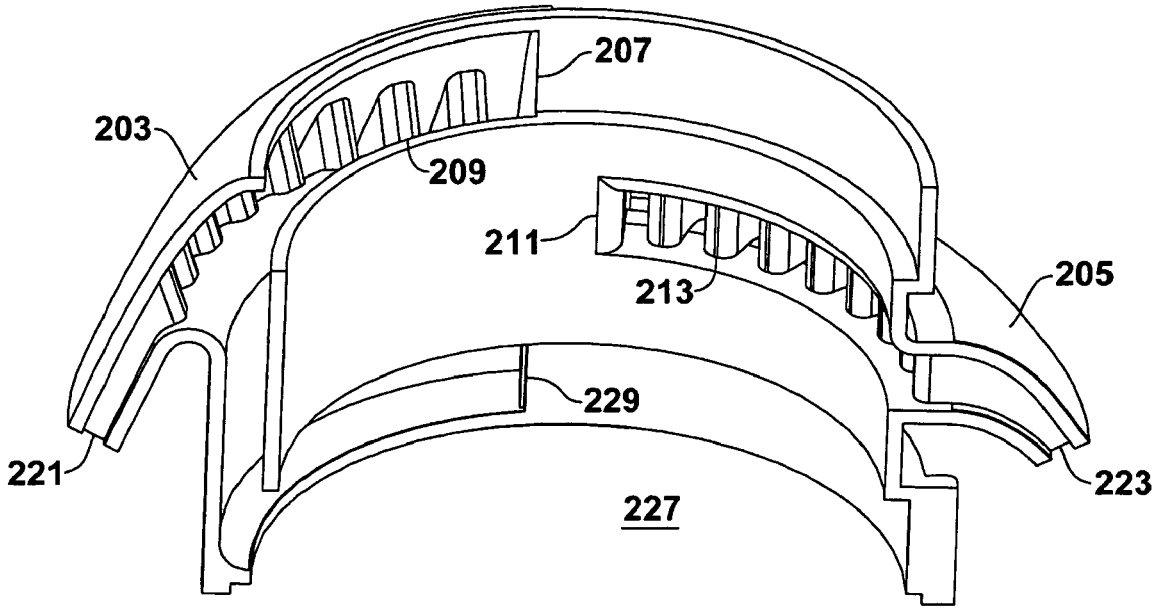
FIG. 35 is a cross-sectional view taken along LINE 35-35 of FIG. 26.

As best seen in FIGS. 34 and 35, the second flow channel element 131 is constructed such that the lower portion of the interior space 227 bounded by the second flow channel element 131 is in fluidic communication with the plurality of channels 223. Similarly, the upper portion of the interior space 227 bounded by the second flow channel element 131 is in fluidic communication with the plurality of channels 221. In operation, the diaphragm 155 (see FIG. 14) of the first synthetic jet actuator 143 creates synthetic jets in the plurality of channels 223, while the diaphragm of the second synthetic jet actuator 145 creates synthetic jets in the plurality of channels 221. As seen in FIG. 5, the second flow channel element 131 directs these synthetic jets into the spaces between adjacent fins 165 of the heat sink 109.

Figure 36:
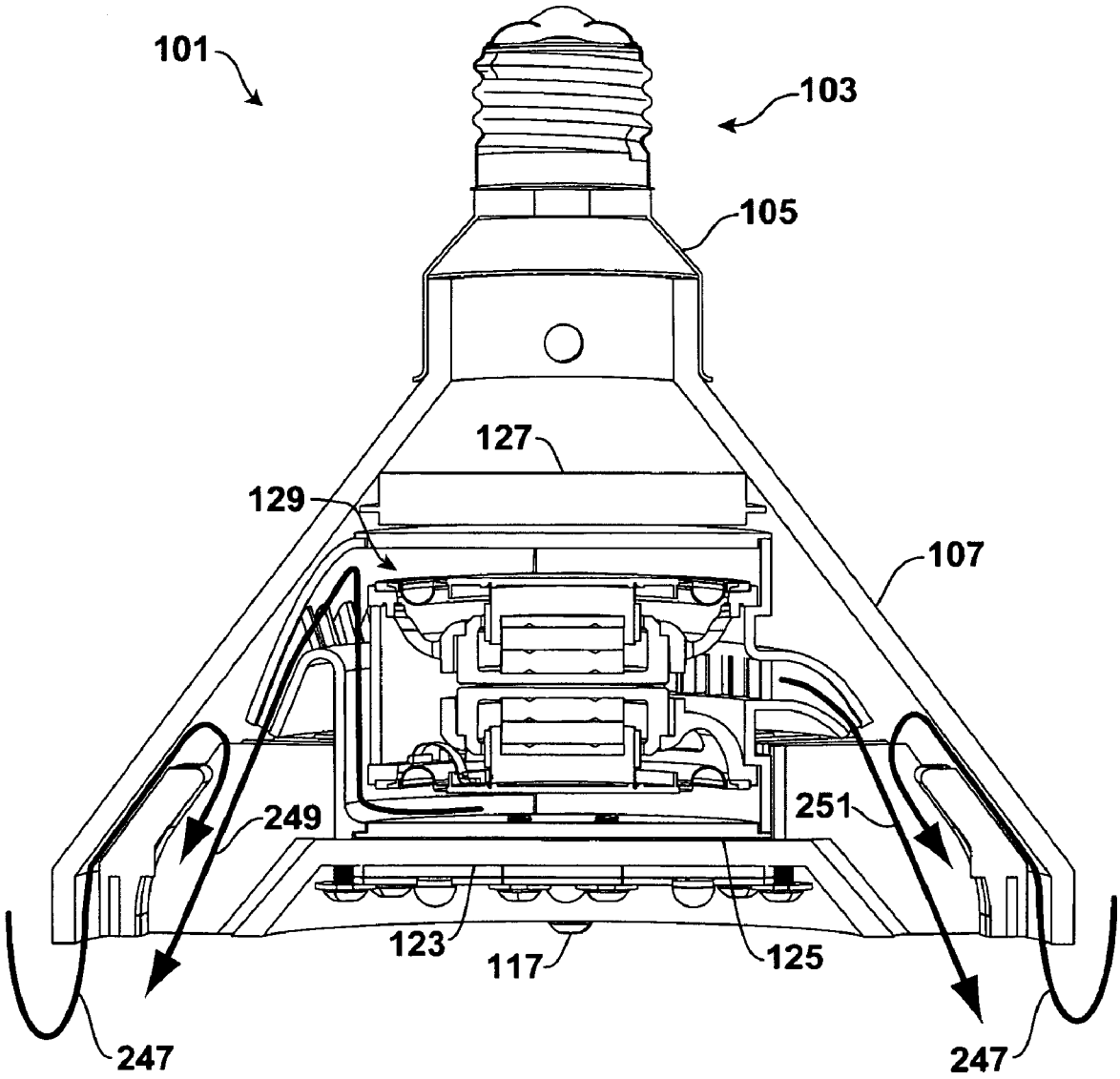
FIG. 36 is a cross-section taken along LINE 36-36 of FIG. 2.

With referenced now to FIG. 36, the operation of the synthetic jet dual actuator assembly 129 is shown. A seen therein, during operation of the synthetic jet dual actuator assembly 129, first 249 and second 251 sets of synthetic jets are generated by the first 143 and second 145 actuators, respectively, and are directed between adjacent pairs of fins 165 in the heat sink 109. The first 249 and second 251 sets of synthetic jets entrain ambient air as shown by arrows 247, thus drawing cool ambient air the interior of the device by way of channels formed by adjacent opposing surfaces of the interior of the exterior housing element 107 and the first flow channel element 111.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. A light source, comprising:

a housing element;

a heat sink;

a first flow channel element which, alone or in combination with said housing element, creates (a) a first set of flow paths for the flow of fluid in a first direction through the light source, and (b) a second set of flow paths for the flow of fluid in a second direction through the light source;

a set of synthetic jet actuators having at least one member and being in fluidic communication with said first set of flow paths; and a set of LEDs containing at least one member and being in thermal contact with said heat sink;

wherein said set of synthetic jet actuators are disposed within a second flow channel element, wherein said second flow channel element is in fluidic communication with said first flow channel element, wherein said second flow channel element is essentially cylindrical in shape and is equipped with a plurality of spouts, and wherein said plurality of spouts are in fluidic communication with said first set of flow paths.

2. The light source of claim 1, wherein said first set of flow paths is in fluidic communication with at least one surface of said heat sink.

3. The light source of claim 1, wherein said first flow channel element is disposed on a major surface of said heat sink.

4. The light source of claim 1, wherein said heat sink has a central portion with a plurality of fins extending radially therefrom, and wherein said set of LEDs is disposed on said central portion.

5. The light source of claim 4, wherein said central portion has first and second opposing surfaces, wherein said set of LEDs is disposed on said first surface, and wherein said first flow channel element is disposed on said second surface.

6. The light source of claim 4, wherein said central portion is essentially planar.

7. The light source of claim 6, wherein each of said plurality of fins is essentially planar, and wherein said plurality of fins are essentially perpendicular to the plane of said central portion.

8. The light source of claim 4, wherein said central portion is essentially circular.

9. The light source of claim 8, wherein said central portion is separated from said plurality of fins by an annular ridge.

10. The light source of claim 1, wherein said first flow channel element releasably engages said plurality of fins.

11. The light source of claim 10, wherein said first flow channel element comprises a plurality of circumferential grooves and a plurality of arcuate sections, and wherein each of said plurality of fins extends into one of said plurality of circumferential grooves.

12. The light source of claim 11, wherein any pair of adjacent circumferential grooves is separated by one of said arcuate sections.

13. The light source of claim 1, wherein said first flow channel element is disposed within said housing element.

14. The light source of claim 1, wherein said heat sink is disposed within said housing element.

15. The light source of claim 1, wherein said set of synthetic jet actuators are disposed within a second flow channel element, and wherein said second flow channel element is in fluidic communication with said first flow channel element.

16. The light source of claim 15, wherein said set of synthetic jet actuators includes first and second actuators, wherein each of said first and second actuators is equipped with an oscillating diaphragm, wherein said second flow channel element is equipped with a first set of flow channels which are in fluidic communication with the diaphragm of said first actuator, and wherein said second flow channel element is equipped with a second set of flow channels which are in fluidic communication with the diaphragm of said second actuator.

17. The light source of claim 16, wherein said first set of flow channels are disposed in a first arcuate extension which protrudes circumferentially from said second flow channel element, and wherein said second set of flow channels are disposed in a second arcuate extension which protrudes circumferentially from said second flow channel element.

18. The light source of claim 1, wherein said heat sink is equipped with a plurality of fins, and wherein each of said spouts is adapted to direct a synthetic jet between an adjacent pair of fins.

19. The light source of claim 1, wherein said set of LEDs contains a plurality of LEDs arranged in an interlocking pattern.

20. The light source of claim 1, wherein said set of synthetic jet actuators is adapted to draw fluid in through said second set of flow paths, and to expel fluid through said first set of flow paths.

21. The light source of claim 20, wherein said housing element terminates in an annular lip, and wherein said second set of flow paths terminate at the periphery of said lip.

22. The light source of claim 1, wherein said set of synthetic jet actuators comprises first and second actuators disposed in opposing relationship to each other.

23. The light source of claim 1, wherein said set of actuators is disposed within said housing element and behind said heat sink.

24. The light source of claim 1, wherein said housing element has first and second ends, and further comprising an electrical contact module which is attached to said second end of said housing element by way of an adapter.

25. The light source of claim 24, wherein said adapter contains first and second annular portions, wherein said first annular portion has a smaller diameter than said second annular portion, and wherein said first and second annular portions are connected to each other by a conical portion.

26. The light source of claim 25, wherein said electrical contact module comprises a threaded metal portion which is attached to the exterior of said first annular portion.

* * * * *